US009169705B2

(12) United States Patent
Helms et al.

(10) Patent No.: US 9,169,705 B2
(45) Date of Patent: Oct. 27, 2015

(54) PRESSURE RELIEF-ASSISTED PACKER

(71) Applicant: Halliburton Energy Services, Inc., Houston, TX (US)

(72) Inventors: Lonnie Carl Helms, Duncan, OK (US); Frank Acosta, Duncan, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 417 days.

(21) Appl. No.: 13/660,678

(22) Filed: Oct. 25, 2012

(65) Prior Publication Data

US 2014/0116699 A1 May 1, 2014

(51) Int. Cl.

| | |
|---|---|
| ***E21B 23/06*** | (2006.01) |
| ***E21B 33/122*** | (2006.01) |
| ***E21B 33/128*** | (2006.01) |

(52) U.S. Cl.

CPC ..... *E21B 23/06* (2013.01); *E21B 33/122* (2013.01); *E21B 33/128* (2013.01)

(58) Field of Classification Search

CPC ..... E21B 23/04; E21B 23/06; E21B 33/1208; E21B 33/128; E21B 33/1285; E21B 34/063

See application file for complete search history.

(56) References Cited

U.S. PATENT DOCUMENTS

| | | | |
|---|---|---|---|
| 2,076,308 | A | 4/1937 | Wells |
| 2,189,936 | A | 2/1940 | Brandfon |
| 2,189,937 | A | 2/1940 | Broyles |
| 2,308,004 | A | 1/1943 | Hart |
| 2,330,265 | A | 9/1943 | Burt |
| 2,373,006 | A | 4/1945 | Baker |
| 2,381,929 | A | 8/1945 | Schlumberger |
| 2,618,340 | A | 11/1952 | Lynd |
| 2,618,343 | A | 11/1952 | Conrad |
| 2,637,402 | A | 5/1953 | Baker et al. |
| 2,640,547 | A | 6/1953 | Baker et al. |
| 2,695,064 | A | 11/1954 | Ragan et al. |
| 2,715,444 | A | 8/1955 | Fewel |
| 2,871,946 | A | 2/1959 | Bigelow |
| 2,918,125 | A | 12/1959 | Sweetman |

(Continued)

FOREIGN PATENT DOCUMENTS

| | | |
|---|---|---|
| WO | 9925070 A2 | 5/1999 |
| WO | 0220942 A1 | 3/2002 |

(Continued)

OTHER PUBLICATIONS

Advisory Action dated Jul. 1, 2014 (3 pages), U.S. Appl. No. 12/688,058, filed Jan. 15, 2010.

(Continued)

*Primary Examiner* — Jennifer H Gay
*Assistant Examiner* — Steven MacDonald
(74) *Attorney, Agent, or Firm* — John W. Wustenberg; Baker Botts L.L.P.

(57) ABSTRACT

A wellbore completion method comprising disposing a pressure relief-assisted packer comprising two packer elements within an axial flow bore of a first tubular string disposed within a wellbore so as to define an annular space between the pressure relief-assisted packer and the first tubular string, and setting the pressure relief-assisted packer such that a portion of the annular space between the two packer elements comes into fluid communication with a pressure relief volume during the setting of the pressure relief-assisted packer.

23 Claims, 5 Drawing Sheets

(56) References Cited

U.S. PATENT DOCUMENTS 2,961,045 A 11/1960 Stogner et al.
2,974,727 A 3/1961 Goodwin
3,029,873 A 4/1962 Hanes
3,055,430 A 9/1962 Campbell
3,122,728 A 2/1964 Lindberg, Jr.
3,160,209 A 12/1964 Bonner
3,195,637 A 7/1965 Wayte
RE25,846 E 8/1965 Campbell
3,217,804 A 11/1965 Peter
3,233,674 A 2/1966 Leutwyler
3,266,575 A 8/1966 Owen
3,398,803 A 8/1968 Leutwyler et al.
3,556,211 A 1/1971 Bohn
3,659,648 A 5/1972 Cobbs
4,085,590 A 4/1978 Powell et al.
4,282,931 A 8/1981 Golben
4,352,397 A 10/1982 Christopher
4,377,209 A 3/1983 Golben
4,385,494 A 5/1983 Golben
4,402,187 A 9/1983 Golben et al.
4,598,769 A 7/1986 Robertson
4,796,699 A 1/1989 Upchurch
4,856,595 A 8/1989 Upchurch
4,884,953 A 12/1989 Golben
5,024,270 A 6/1991 Bostick
5,040,602 A 8/1991 Helms
5,058,674 A 10/1991 Schultz et al.
5,074,940 A 12/1991 Ochi et al.
5,089,069 A 2/1992 Ramaswamy et al.
5,101,907 A 4/1992 Schultz et al.
5,117,548 A 6/1992 Griffith et al.
5,155,471 A 10/1992 Ellis et al.
5,163,521 A 11/1992 Pustanyk et al.
5,188,183 A 2/1993 Hopmann et al.
5,197,758 A 3/1993 Lund et al.
5,211,224 A 5/1993 Bouldin
5,238,070 A 8/1993 Schultz et al.
5,279,321 A 1/1994 Krimm
5,316,081 A 5/1994 Baski et al.
5,316,087 A 5/1994 Manke et al.
5,355,960 A 10/1994 Schultz et al.
5,396,951 A 3/1995 Ross
5,452,763 A 9/1995 Owen
5,476,018 A 12/1995 Nakanishi et al.
5,485,884 A 1/1996 Hanley et al.
5,490,564 A 2/1996 Schultz et al.
5,531,845 A 7/1996 Flanigan et al.
5,549,165 A * 8/1996 Brooks ..... 166/386
5,558,153 A 9/1996 Holcombe et al.
5,573,307 A 11/1996 Wilkinson et al.
5,575,331 A 11/1996 Terrell
5,622,211 A 4/1997 Martin et al.
5,662,166 A 9/1997 Shammai
5,673,556 A 10/1997 Goldben et al.
5,687,791 A 11/1997 Beck et al.
5,700,974 A 12/1997 Taylor
5,725,699 A 3/1998 Hinshaw et al.
6,128,904 A 10/2000 Rosso, Jr. et al.
6,137,747 A 10/2000 Shah et al.
6,172,614 B1 1/2001 Robison et al.
6,186,226 B1 2/2001 Robertson
6,196,584 B1 3/2001 Shirk et al.
6,315,043 B1 11/2001 Farrant et al.
6,333,699 B1 12/2001 Zierolf
6,364,037 B1 4/2002 Brunnert et al.
6,378,611 B1 4/2002 Helderle
6,382,234 B1 5/2002 Birckhead et al.
6,438,070 B1 8/2002 Birchak et al.
6,450,258 B2 9/2002 Green et al.
6,450,263 B1 9/2002 Schwendemann
6,470,996 B1 10/2002 Kyle et al.
6,536,524 B1 3/2003 Snider
6,561,479 B1 5/2003 Eldridge
6,568,470 B2 5/2003 Goodson, Jr. et al.
6,583,729 B1 6/2003 Gardner et al.
6,584,911 B2 7/2003 Bergerson et al.
6,598,679 B2 7/2003 Robertson
6,619,388 B2 9/2003 Dietz et al.
6,651,747 B2 11/2003 Chen et al.
6,668,937 B1 12/2003 Murray
6,672,382 B2 1/2004 Schultz et al.
6,695,061 B2 2/2004 Fripp et al.
6,705,425 B2 3/2004 West
6,717,283 B2 4/2004 Skinner et al.
6,776,255 B2 8/2004 West et al.
6,848,503 B2 2/2005 Schultz et al.
6,880,634 B2 4/2005 Gardner et al.
6,915,848 B2 7/2005 Thomeer et al.
6,925,937 B2 8/2005 Robertson
6,971,449 B1 12/2005 Robertson
6,973,993 B2 12/2005 West et al.
6,998,999 B2 2/2006 Fripp et al.
7,012,545 B2 3/2006 Skinner et al.
7,063,146 B2 6/2006 Schultz et al.
7,063,148 B2 6/2006 Jabusch
7,068,183 B2 6/2006 Shah et al.
7,082,078 B2 7/2006 Fripp et al.
7,083,009 B2 8/2006 Paluch et al.
7,104,276 B2 9/2006 Einhaus
7,152,657 B2 12/2006 Bosma et al.
7,152,679 B2 12/2006 Simpson
7,165,608 B2 1/2007 Schultz et al.
7,191,672 B2 3/2007 Ringgenberg et al.
7,195,067 B2 3/2007 Manke et al.
7,197,923 B1 4/2007 Wright et al.
7,199,480 B2 4/2007 Fripp et al.
7,201,230 B2 4/2007 Schultz et al.
7,210,555 B2 5/2007 Shah et al
7,234,519 B2 6/2007 Fripp et al.
7,237,616 B2 7/2007 Patel
7,246,659 B2 7/2007 Fripp et al.
7,246,660 B2 7/2007 Fripp et al.
7,252,152 B2 8/2007 LoGiudice et al.
7,258,169 B2 8/2007 Fripp et al.
7,301,472 B2 11/2007 Kyle et al.
7,301,473 B2 11/2007 Shah et al.
7,322,416 B2 1/2008 Burris, II et al.
7,325,605 B2 2/2008 Fripp et al.
7,337,852 B2 3/2008 Manke et al.
7,339,494 B2 3/2008 Shah et al.
7,363,967 B2 4/2008 Burris, II et al.
7,367,394 B2 5/2008 Villareal et al.
7,372,263 B2 5/2008 Edwards
7,373,944 B2 5/2008 Smith et al.
7,387,165 B2 6/2008 Lopez de Cardenas et al.
7,395,882 B2 7/2008 Oldham et al.
7,398,996 B2 7/2008 Saito et al.
7,404,416 B2 7/2008 Schultz et al.
7,428,922 B2 9/2008 Fripp et al.
7,431,335 B2 10/2008 Khandhadia et al.
7,472,589 B2 1/2009 Irani et al.
7,472,752 B2 1/2009 Rogers et al.
7,508,734 B2 3/2009 Fink et al.
7,510,017 B2 3/2009 Howell et al.
7,557,492 B2 7/2009 Fripp et al.
7,559,363 B2 7/2009 Howell et al.
7,559,373 B2 7/2009 Jackson et al.
7,595,737 B2 9/2009 Fink et al.
7,596,995 B2 10/2009 Irani et al.
7,604,062 B2 10/2009 Murray
7,610,964 B2 11/2009 Cox
7,617,871 B2 11/2009 Surjaatmadja et al.
7,624,792 B2 12/2009 Wright et al.
7,640,965 B2 1/2010 Bosma et al.
7,665,355 B2 2/2010 Zhang et al.
7,669,661 B2 3/2010 Johnson
7,673,506 B2 3/2010 Irani et al.
7,673,673 B2 3/2010 Surjaatmadja et al.
7,699,101 B2 4/2010 Fripp et al.
7,699,102 B2 4/2010 Storm et al.
7,712,527 B2 5/2010 Roddy
7,717,167 B2 5/2010 Storm et al.
7,730,954 B2 6/2010 Schultz et al.
7,777,645 B2 8/2010 Shah et al.

(56) References Cited

U.S. PATENT DOCUMENTS

| | | | |
|---|---|---|---|
| 7,781,939 | B2 | 8/2010 | Fripp et al. |
| 7,802,627 | B2 | 9/2010 | Hofman et al. |
| 7,804,172 | B2 | 9/2010 | Schultz et al. |
| 7,832,474 | B2 | 11/2010 | Nguy |
| 7,836,952 | B2 | 11/2010 | Fripp |
| 7,856,872 | B2 | 12/2010 | Irani et al. |
| 7,878,255 | B2 | 2/2011 | Howell et al. |
| 7,946,166 | B2 | 5/2011 | Irani et al. |
| 7,946,340 | B2 | 5/2011 | Surjaatmadja et al. |
| 7,963,331 | B2 | 6/2011 | Surjaatmadja et al. |
| 7,987,914 | B2 | 8/2011 | Benton |
| 8,040,249 | B2 | 10/2011 | Shah et al. |
| 8,091,637 | B2 | 1/2012 | Fripp |
| 8,118,098 | B2 | 2/2012 | Hromas et al. |
| 8,140,010 | B2 | 3/2012 | Symons et al. |
| 8,146,673 | B2 | 4/2012 | Howell et al. |
| 8,162,050 | B2 | 4/2012 | Roddy et al. |
| 8,191,627 | B2 | 6/2012 | Hamid et al. |
| 8,196,515 | B2 | 6/2012 | Streibich et al. |
| 8,196,653 | B2 | 6/2012 | Fripp et al. |
| 8,215,404 | B2 | 7/2012 | Makowiecki et al. |
| 8,220,545 | B2 | 7/2012 | Storm, Jr. et al. |
| 8,225,014 | B2 | 7/2012 | Kuhl |
| 8,235,103 | B2 | 8/2012 | Wright et al. |
| 8,235,128 | B2 | 8/2012 | Dykstra et al. |
| 8,240,384 | B2 | 8/2012 | Miller et al. |
| 8,261,839 | B2 | 9/2012 | Fripp et al. |
| 8,276,669 | B2 | 10/2012 | Dykstra et al. |
| 8,276,675 | B2 | 10/2012 | Williamson et al. |
| 8,284,075 | B2 | 10/2012 | Fincher et al. |
| 8,297,367 | B2 | 10/2012 | Chen et al. |
| 8,302,681 | B2 | 11/2012 | Fripp et al. |
| 8,319,657 | B2 | 11/2012 | Godager |
| 8,322,426 | B2 | 12/2012 | Wright et al. |
| 8,327,885 | B2 | 12/2012 | Dykstra et al. |
| 8,356,668 | B2 | 1/2013 | Dykstra et al. |
| 8,376,047 | B2 | 2/2013 | Dykstra et al. |
| 8,387,662 | B2 | 3/2013 | Dykstra et al. |
| 8,397,803 | B2 | 3/2013 | Crabb et al. |
| 8,403,068 | B2 | 3/2013 | Robison et al. |
| 8,432,167 | B2 | 4/2013 | Reiderman |
| 8,472,282 | B2 | 6/2013 | Fink et al. |
| 8,479,831 | B2 | 7/2013 | Dykstra et al. |
| 8,505,639 | B2 | 8/2013 | Robison et al. |
| 2004/0156264 | A1 | 8/2004 | Gardner et al. |
| 2004/0227509 | A1 | 11/2004 | Ucan |
| 2005/0241835 | A1 | 11/2005 | Burris, II et al. |
| 2005/0260468 | A1 | 11/2005 | Fripp et al. |
| 2005/0269083 | A1 | 12/2005 | Burris, II et al. |
| 2006/0118303 | A1 | 6/2006 | Schultz et al. |
| 2006/0131030 | A1 | 6/2006 | Sheffield |
| 2006/0144590 | A1 | 7/2006 | Lopez de Cardenas et al. |
| 2006/0196539 | A1* | 9/2006 | Raska et al. ..... 137/68.24 |
| 2006/0219438 | A1 | 10/2006 | Moore et al. |
| 2007/0089911 | A1 | 4/2007 | Moyes |
| 2007/0189452 | A1 | 8/2007 | Johnson et al. |
| 2008/0135248 | A1 | 6/2008 | Talley et al. |
| 2008/0137481 | A1 | 6/2008 | Shah et al. |
| 2008/0202766 | A1 | 8/2008 | Howell et al. |
| 2009/0192731 | A1 | 7/2009 | De Jesus et al. |
| 2009/0308588 | A1 | 12/2009 | Howell et al. |
| 2010/0065125 | A1 | 3/2010 | Telfer |
| 2010/0084060 | A1 | 4/2010 | Hinshaw et al. |
| 2010/0201352 | A1 | 8/2010 | Englert |
| 2011/0042092 | A1 | 2/2011 | Fripp et al. |
| 2011/0079386 | A1 | 4/2011 | Fripp et al. |
| 2011/0139445 | A1 | 6/2011 | Fripp et al. |
| 2011/0168390 | A1 | 7/2011 | Fripp et al. |
| 2011/0174484 | A1 | 7/2011 | Wright et al. |
| 2011/0174504 | A1 | 7/2011 | Wright et al. |
| 2011/0199859 | A1 | 8/2011 | Fink et al. |
| 2011/0214853 | A1 | 9/2011 | Robichaux et al. |
| 2011/0253383 | A1 | 10/2011 | Porter et al. |
| 2011/0266001 | A1 | 11/2011 | Dykstra et al. |
| 2011/0308806 | A9 | 12/2011 | Dykstra et al. |
| 2012/0018167 | A1 | 1/2012 | Konopczynski et al. |
| 2012/0048531 | A1 | 3/2012 | Marzouk et al. |
| 2012/0075113 | A1 | 3/2012 | Loi et al. |
| 2012/0111577 | A1 | 5/2012 | Dykstra et al. |
| 2012/0138292 | A1 | 6/2012 | Miller |
| 2012/0146805 | A1 | 6/2012 | Vick, Jr. et al. |
| 2012/0152527 | A1 | 6/2012 | Dykstra et al. |
| 2012/0179428 | A1 | 7/2012 | Dykstra et al. |
| 2012/0186819 | A1 | 7/2012 | Dagenais et al. |
| 2012/0205120 | A1 | 8/2012 | Howell |
| 2012/0205121 | A1 | 8/2012 | Porter et al. |
| 2012/0211243 | A1 | 8/2012 | Dykstra et al. |
| 2012/0234557 | A1 | 9/2012 | Dykstra et al. |
| 2012/0241143 | A1 | 9/2012 | Wright et al. |
| 2012/0255739 | A1 | 10/2012 | Fripp et al. |
| 2012/0255740 | A1 | 10/2012 | Fripp et al. |
| 2012/0279593 | A1 | 11/2012 | Fripp et al. |
| 2012/0313790 | A1 | 12/2012 | Heijnen et al. |
| 2012/0318511 | A1 | 12/2012 | Dykstra et al. |
| 2012/0318526 | A1 | 12/2012 | Dykstra et al. |
| 2012/0323378 | A1 | 12/2012 | Dykstra et al. |
| 2013/0000922 | A1 | 1/2013 | Skinner et al. |
| 2013/0014940 | A1 | 1/2013 | Fripp et al. |
| 2013/0014941 | A1 | 1/2013 | Tips et al. |
| 2013/0014955 | A1 | 1/2013 | Fripp et al. |
| 2013/0014959 | A1 | 1/2013 | Tips et al. |
| 2013/0020090 | A1 | 1/2013 | Fripp et al. |
| 2013/0048290 | A1 | 2/2013 | Howell et al. |
| 2013/0048291 | A1 | 2/2013 | Merron et al. |
| 2013/0048298 | A1 | 2/2013 | Merron et al. |
| 2013/0048299 | A1 | 2/2013 | Fripp et al. |
| 2013/0048301 | A1 | 2/2013 | Gano et al. |
| 2013/0075107 | A1 | 3/2013 | Dykstra et al. |
| 2013/0092381 | A1 | 4/2013 | Dykstra et al. |
| 2013/0092382 | A1 | 4/2013 | Dykstra et al. |
| 2013/0092392 | A1 | 4/2013 | Dykstra et al. |
| 2013/0092393 | A1 | 4/2013 | Dykstra et al. |
| 2013/0098614 | A1 | 4/2013 | Dagenais et al. |
| 2013/0106366 | A1 | 5/2013 | Fripp et al. |
| 2013/0112423 | A1 | 5/2013 | Dykstra et al. |
| 2013/0112424 | A1 | 5/2013 | Dykstra et al. |
| 2013/0112425 | A1 | 5/2013 | Dykstra et al. |
| 2013/0122296 | A1 | 5/2013 | Rose et al. |
| 2013/0140038 | A1 | 6/2013 | Fripp et al. |
| 2013/0153238 | A1 | 6/2013 | Fripp et al. |
| 2013/0180727 | A1 | 7/2013 | Dykstra et al. |
| 2013/0180732 | A1 | 7/2013 | Acosta et al. |
| 2013/0186634 | A1 | 7/2013 | Fripp et al. |
| 2013/0192829 | A1 | 8/2013 | Fadul et al. |

FOREIGN PATENT DOCUMENTS

| | | | |
|---|---|---|---|
| WO | 2004018833 | A1 | 3/2004 |
| WO | 2004099564 | A2 | 11/2004 |
| WO | 2010002270 | A2 | 1/2010 |
| WO | 2010111076 | A2 | 9/2010 |
| WO | 2011021053 | A2 | 2/2011 |
| WO | 2011087721 | A1 | 7/2011 |
| WO | 2012078204 | A1 | 6/2012 |
| WO | 2012082248 | A1 | 6/2012 |
| WO | 2013032687 | A2 | 3/2013 |
| WO | 2013032687 | A3 | 3/2013 |
| WO | 2014092836 | A1 | 6/2014 |

OTHER PUBLICATIONS

Foreign communication from a related counterpart application—Australian Office Action, AU Application No. 2010341610, Feb. 27, 2014, 5 pages.

Notice of Allowance dated Jul. 15, 2014 (28 pages), U.S. Appl. No. 12/688,058, filed Jan. 15, 2010.

Office Action (Final) dated Mar. 10, 2014 (13 pages), U.S. Appl. No. 12/688,058, filed Jan. 15, 2010.

Office Action (Final) dated May 9, 2014 (16 pages), U.S. Appl. No. 12/965,859, filed Dec. 11, 2010.

Office Action (Final) dated Jul. 22, 2014 (21 pages), U.S. Appl. No. 13/905,859, filed May 30, 2013.

(56) References Cited

OTHER PUBLICATIONS

Filing receipt and specification for provisional patent application entitled "Wellbore Servicing Tools, Systems and Methods Utilizing Near-Field Communication," by Zachary William Walton, et al., filed Mar. 12, 2013 as U.S. Appl. No. 61/778,312.
Filing receipt and specification for patent application entitled "Dual Magnetic Sensor Actuation Assembly," by Zachary W. Walton, et al., filed Mar. 14, 2013 as U.S. Appl. No. 13/828,824.
Filing receipt and specification for patent application entitled "Method and Apparatus for Magnetic Pulse Signature Actuation," by Zachary W. Walton, et al., filed Feb. 28, 2013 as U.S. Appl. No. 13/781,093.
Filing receipt and specification for patent application entitled "Gas Generator for Pressurizing Downhole Samples," by Scott L. Miller, et al., filed May 30, 2013 as U.S. Appl. No. 13/905,859.
Filing receipt and specification for patent application entitled "Wellbore Servicing Tools, Systems and Methods Utilizing Downhole Wireless Switches," by Michael Linley Fripp, et al., filed on May 31, 2013 as U.S. Appl. No. 13/907,593.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/913,881.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,004.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,114.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,177.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,216.
Filing receipt and specification for patent application entitled "Wellbore Servicing Tools, Systems, and Methods Utilizing Near-Field Communication," by Zachary William Walton, et al., filed Jun. 10, 2013 as U.S. Appl. No. 13/914,238.
Filing receipt and specification for International application entitled "Pressure Equalization for Dual Seat Ball Valve," filed Mar. 8, 2013 as International application No. PCT/US2013/027666.
Filing receipt and specification for International application entitled "Autofill and Circulation Assembly and Method of Using the Same," filed Mar. 5, 2013 as International application No. PCT/US2013/027674.
Foreign communication from a related counterpart application—International Preliminary Report on Patentability, PCT/US2011/036686, Jun. 12, 2013, 5 pages.
Paus, Annika, "Near Field Communication in Cell Phones," Jul. 24, 2007, pp. 1-22 plus 1 cover and 1 content pages.
Sanni, Modiu L., et al., "Reservoir Nanorobots," Saudi Aramco Journal of Technology, Spring 2008, pp. 44-52.
Ward, Matt, et al., "RFID: Frequency, standards, adoption and innovation," JISC Technology and Standards Watch, May 2006, pp. 1-36.
Danaher product information, Motion Brakes, http://www.danahermotion.com/website/usa/eng/products/clutches_and_brakes/115836.php, Mar. 4, 2009, 3 pages, Danaher Motion.
Halliburton brochure entitled "Armada™ Sampling System," Sep. 2007, 2 pages.
Halliburton Drawing 672.03800, May 4, 1994, p. 1 of 2.
Halliburton Drawing 672.03800, May 4, 1994, p. 2 of 2.
Halliburton Drawing 626.02100, Apr. 20, 1999, 2 pages.
Magneta Electromagnetic Clutches and Brakes catalog, Jan. 2004, 28 pages, Magneta GmbH & Co KG.
Ogura product information, "Electromagnetic Clutch/Brake," http://www.ogura-clutch.com/products.html?category=2&by=type&no=1, Mar. 4, 2009, 4 pages, Ogura Industrial Corp.
Advisory Action dated Feb. 12, 2013 (3 pages), U.S. Appl. No. 12/962,621, filed Dec. 7, 2010.
Filing receipt and specification for patent application entitled "Double Ramp Compression Packer," by Frank V. Acosta, et al., filed Jan. 13, 2012 as U.S. Appl. No. 13/350,030.
Filing receipt and specification for patent application entitled "Remotely Activated Down Hole Systems and Methods," by Frank V. Acosta, et al., filed Mar. 7, 2012 as U.S. Appl. No. 13/414,016.
Filing receipt and specification for patent application entitled "External Casing Packer and Method of Performing Cementing Job," by Lonnie Helms, et al., filed Mar. 7, 2012 as U.S. Appl. No. 13/414,140.
Filing receipt and specification for patent application entitled "Method of Completing a Multi-Zone Fracture Stimulation Treatment of a Wellbore," by Steven G. Streich, et al., filed Sep. 21, 2012 as U.S. Appl. No. 13/624,173.
Foreign communication from a related counterpart application—International Preliminary Report on Patentability, PCT/US2010/061047, Jul. 17, 2012, 5 pages.
Foreign communication from a related counterpart application—International Search Report and Written Opinion, PCT/US2010/061047, Jun. 23, 2011, 7 pages.
Foreign communication from a related counterpart application—International Search Report and Written Opinion, PCT/US2011/036686, Nov. 30, 2011, 8 pages.
Foreign communication from a related counterpart application—International Search Report and Written Opinion, PCT/US2012/050762, Mar. 11, 2013, 12 pages.
Notice of Allowance dated Apr. 11, 2013 (9 pages), U.S. Appl. No. 12/962,621, filed Dec. 7, 2010.
Office Action dated Dec. 22, 2011 (30 pages), U.S. Appl. No. 12/965,859, filed Dec. 11, 2010.
Office Action dated Dec. 23, 2011 (34 pages), U.S. Appl. No. 12/688,058, filed Jan. 15, 2010.
Office Action dated Jun. 26, 2012 (41 pages), U.S. Appl. No. 12/962,621, filed Dec. 7, 2010.
Office Action (Final) dated Nov. 27, 2012 (23 pages), U.S. Appl. No. 12/962,621, filed Dec. 7, 2010.
Office Action dated Dec. 24, 2012 (26 pages), U.S. Appl. No. 12/688,058, filed Jan. 15, 2010.
Office Action dated Sep. 19, 2013 (17 pages), U.S. Appl. No. 12/688,058, filed Jan. 15, 2010.
Office Action dated Sep. 19, 2013 (30 pages), U.S. Appl. No. 12/965,859, filed Dec. 11, 2010.
Office Action dated Dec. 3, 2013 (46 pages), U.S. Appl. No. 13/905,859, filed May 30, 2013.
Foreign communication from a related counterpart application—International Search Report and Written Opinion, PCT/US2013/061386, Apr. 10, 2014, 12 pages.

* cited by examiner

PRESSURE RELIEF-ASSISTED PACKER

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Oil and gas wells are often cased from the surface location of the wells down to and sometimes through a production formation. Casing, (e.g., steel pipe) is lowered into the wellbore to a desired depth. Often, at least a portion of the space between the casing and the wellbore, i.e. the annulus, is then typically filled with cement (e.g., cemented). Once the cement sets in the annulus, it holds the casing in place and prevents flow of fluids to, from, or between earth formations (or portions thereof) through which the well passes (e.g., aquifers).

It is sometimes desirable to complete the well or a portion there-of as an open-hole completion. Generally, this means that at least a portion of the well is not cased, for example, through the producing zone or zones. However, the well may still be cased and cemented from the surface location down to a depth just above the producing formation. It is desirable not to fill or contaminate the open-hole portion of the well with cement during the cementing process.

Sometimes, a second casing string or liner may be later incorporated with the previously installed casing string. In order to join the second casing string to the first casing string, the second casing string may need to be fixed into position, for example, using casing packers, cement, and/or any combination of any other suitable methods. One or more methods, systems, and/or apparatuses which may be employed to secure a second casing string with respect to (e.g., within) a first casing string are disclosed herein.

SUMMARY

Disclosed herein is a wellbore completion method comprising disposing a pressure relief-assisted packer comprising two packer elements within an axial flow bore of a first tubular string disposed within a wellbore so as to define an annular space between the pressure relief-assisted packer and the first tubular string, and setting the pressure relief-assisted packer such that a portion of the annular space between the two packer elements comes into fluid communication with a pressure relief volume during the setting of the pressure relief-assisted packer.

Also disclosed herein is a wellbore completion system comprising a pressure relief-assisted packer, wherein the pressure relief-assisted packer is disposed within an axial flow bore of a first casing string disposed within a wellbore penetrating a subterranean formation, and wherein the pressure relief-assisted packer comprises a first packer element, a second packer element, and a pressure relief chamber, the pressure relief chamber at least partially defining a pressure relief volume, wherein the pressure relief volume relieves a pressure between the first packer element and the second packer element, and a second casing string, wherein the pressure relief-assisted packer is incorporated within the second casing string.

Further disclosed herein is a wellbore completion method comprising disposing a pressure relief-assisted packer within an axial flow bore of a first tubular string disposed within a wellbore, wherein the pressure relief-assisted packer comprises a first packer element, a second packer element, and a pressure relief chamber, the pressure relief chamber at least partially defining a pressure relief volume, causing the first packer element and the second packer element to expand radially so as to engage the first tubular string, wherein causing the first packer element and the second packer element to expand radially causes an increase in pressure in an annular space between the first packer element and the second packer element, wherein the increase in pressure in the annular space causes the pressure relief volume to come into fluid communication with the annular space.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
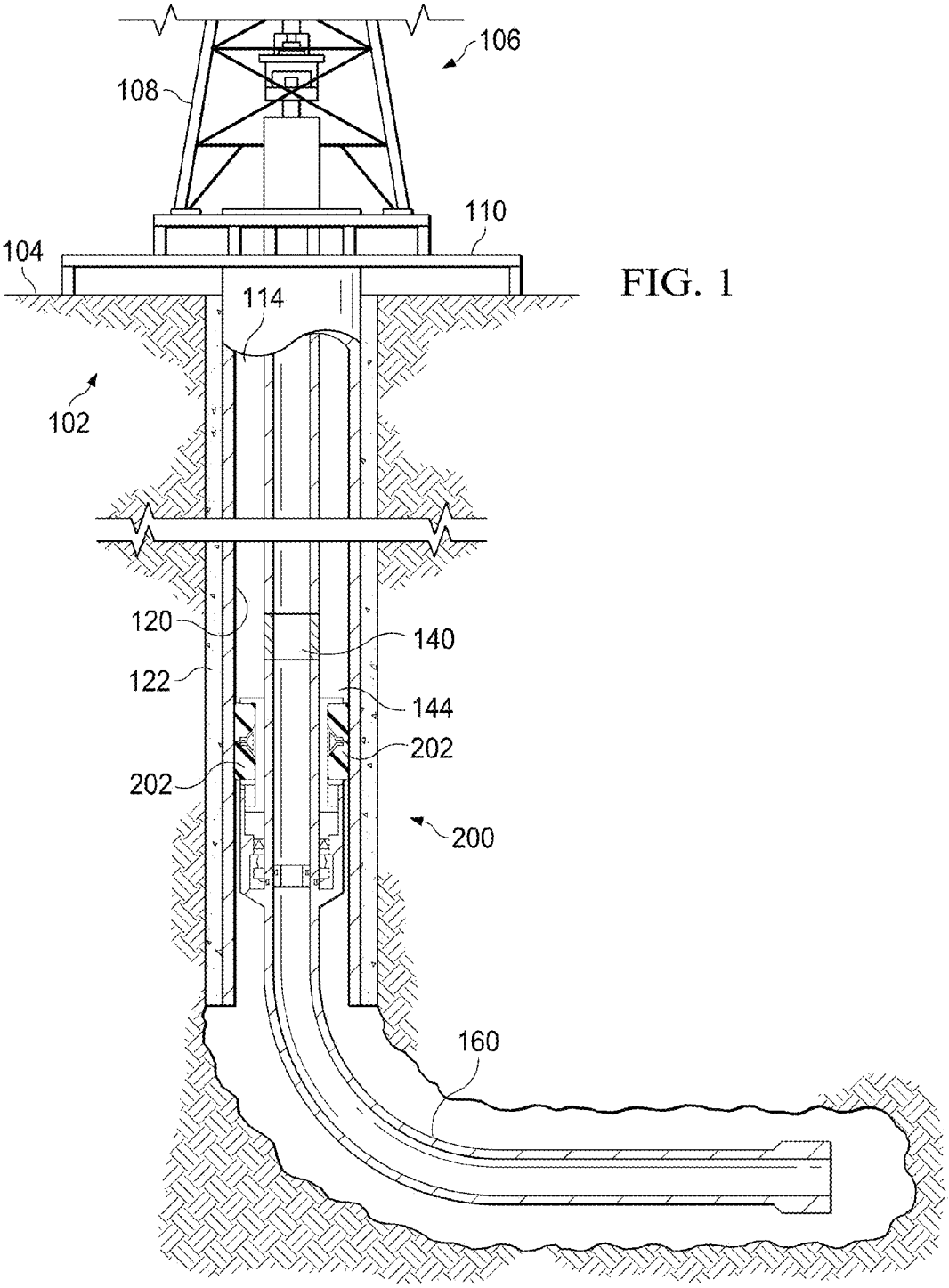
FIG. 1 is a partial cut-away view of an operating environment of a pressure relief-assisted packer depicting a wellbore penetrating the subterranean formation, a first casing string positioned within the wellbore, and a second casing string positioned within the first casing string.

In the drawings and description that follow, like parts are typically marked throughout the specification and drawings with the same reference numerals, respectively. In addition, similar reference numerals may refer to similar components in different embodiments disclosed herein. The drawing figures are not necessarily to scale. Certain features of the invention may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is not intended to limit the invention to the embodiments illustrated and described herein. It is to be fully recognized that the different teachings of the embodiments discussed herein may be employed separately or in any suitable combination to produce desired results.

Unless otherwise specified, use of the terms "connect," "engage," "couple," "attach," or any other like term describing an interaction between elements is not meant to limit the interaction to direct interaction between the elements and may also include indirect interaction between the elements described.

Unless otherwise specified, use of the terms "up," "upper," "upward," "up-hole," "upstream," or other like terms shall be construed as generally from the formation toward the surface or toward the surface of a body of water; likewise, use of "down," "lower," "downward," "down-hole," "downstream," or other like terms shall be construed as generally into the formation away from the surface or away from the surface of a body of water, regardless of the wellbore orientation. Use of any one or more of the foregoing terms shall not be construed as denoting positions along a perfectly vertical axis.

Unless otherwise specified, use of the term "subterranean formation" shall be construed as encompassing both areas below exposed earth and areas below earth covered by water such as ocean or fresh water.

Disclosed herein are embodiments of a pressure relief-assisted packer (PRP) and methods of using the same. Following the placement of a first tubular (e.g., casing string) within a wellbore, it may be desirable to place and secure a second tubular within a wellbore, for example, within a first casing string. In embodiments disclosed herein, a wellbore completion and/or cementing tool comprising a PRP is attached and/or incorporated within the second tubular (e.g., a second casing string or liner), for example, which is to be secured with respect to the first casing string. Particularly, the PRP may be configured to provide an improved connection between the first casing string and the tubular, for example, by the increased compression provided by the PRP. The use of the PRP may enable a more secure (e.g., rigid) connection between the first casing string and the tubular (e.g., the second casing string or liner) and may isolate two or more portions of an annular space, for example, for the purpose of subsequent wellbore completion and/or cementing operations.

It is noted that, although, a PRP is referred to as being incorporated within a second tubular (such as a casing string, liner, or the like) in one or more embodiments, the specification should not be construed as so-limiting, and a PRP in accordance with the present disclosure may be used in any suitable working environment and configuration.

Referring to FIG. 1, an embodiment of an operating environment in which a PRP may be utilized is illustrated. It is noted that although some of the figures may exemplify horizontal or vertical wellbores, the principles of the methods, apparatuses, and systems disclosed herein may be similarly applicable to horizontal wellbore configurations, conventional vertical wellbore configurations, and combinations thereof. Therefore, the horizontal or vertical nature of any figure is not to be construed as limiting the wellbore to any particular configuration.

Referring to FIG. 1, the operating environment comprises a drilling or servicing rig 106 that is positioned on the earth's surface 104 and extends over and around a wellbore 114 that penetrates a subterranean formation 102. The wellbore 114 may be drilled into the subterranean formation 102 by any suitable drilling technique. In an embodiment, the drilling or servicing rig 106 comprises a derrick 108 with a rig floor 110 through which a casing string or other tubular string may be positioned within the wellbore 114. The drilling or servicing rig 106 may be conventional and may further comprise a motor driven winch and other associated equipment for lowering the casing and/or tubular into the wellbore 114 and to position the casing and/or tubular at the desired depth.

In an embodiment, the wellbore 114 may extend substantially vertically away from the earth's surface 104 over a vertical wellbore portion, or may deviate at any angle from the earth's surface 104 over a deviated or horizontal wellbore portion. In alternative operating environments, portions or substantially all of the wellbore 114 may be vertical, deviated, horizontal, and/or curved.

In an embodiment, at least a portion (e.g., an upper portion) of the wellbore 114 proximate to and/or extending from the earth's surface 104 into the subterranean formation 102 may be cased with a first casing string 120, leaving a portion (e.g., a lower portion) of the wellbore 114 in an open-hole condition, for example, in a production portion of the formation. In an embodiment, at least a portion of the first casing string 120 may be secured into position against the formation 102 using conventional methods as appreciated by one of skill in the art (e.g., using cement 122). In such an embodiment, the wellbore 114 may be partially cased and cemented thereby resulting in a portion of the wellbore 114 being uncemented. Additionally and/or alternatively, the first casing string 120 may be secured into the formation 102 using one or more packers, as would be appreciated by one of skill in the art.

In the embodiment of FIG. 1, the second tubular 160 is positioned within a first casing string 120 (e.g., within a flowbore of the first casing string 120) within the wellbore 114. In the embodiment of FIG. 1, a PRP 200, as will be disclosed herein, is incorporated within the tubular 160. The second tubular 160 having the PRP 200 incorporated therein may be delivered to a predetermined depth within the wellbore 114. In an embodiment, the second tubular 160 may further comprise a multiple stage cementing tool 140. For example, in the embodiment of FIG. 1, a multiple stage cementing tool 140 is incorporated within the second tubular 160 uphole (e.g., above) relative to the PRP 200. In such an embodiment, the multiple stage cementing tool 140 may be configured to selectively allow fluid communication (e.g., via one or more ports) from the axial flowbore of the second tubular 160 to an annular space 144 extending between the first casing string 120 and the second tubular 160

Figure 2A:
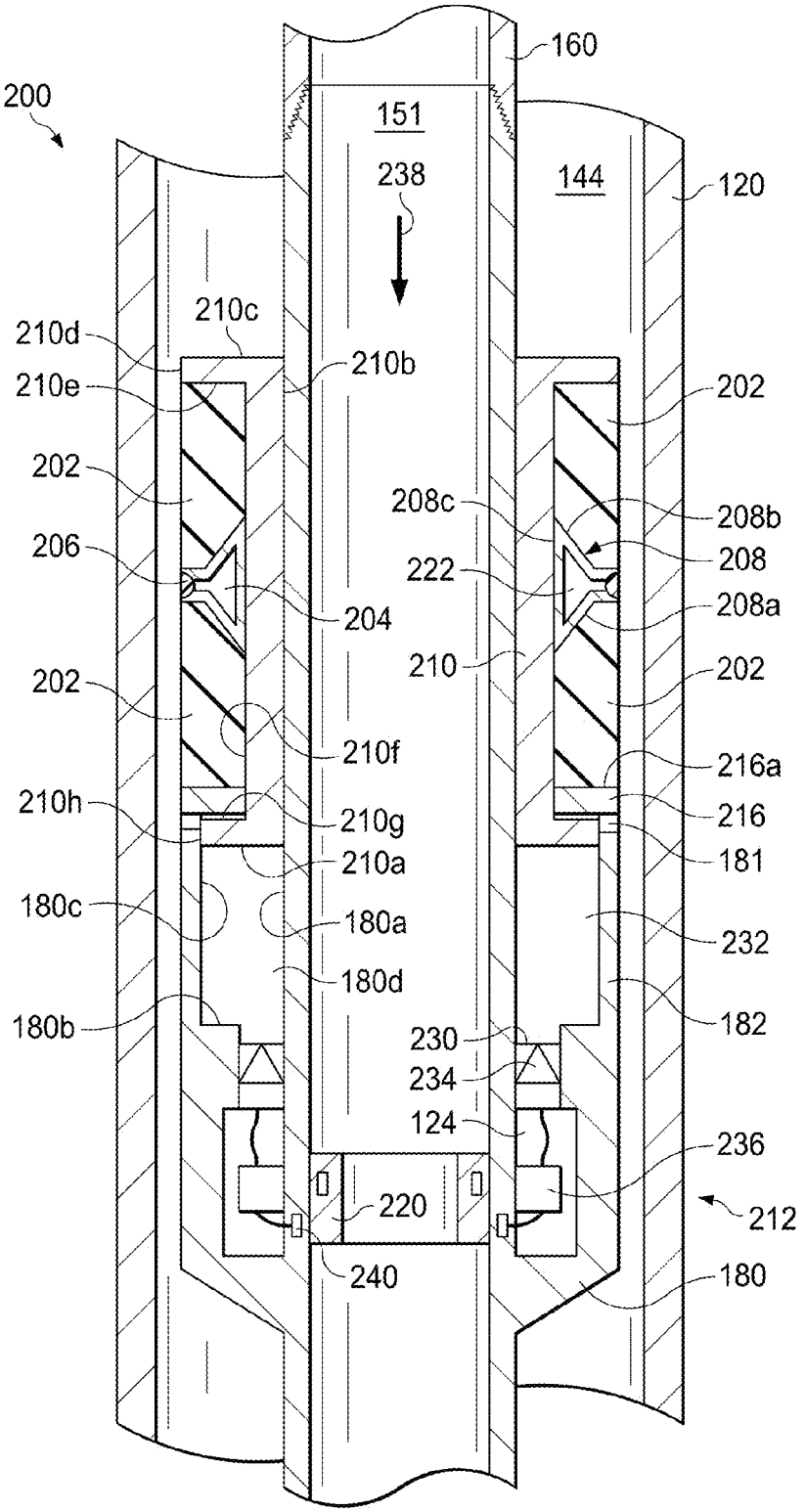
FIG. 2A is a cut-away view of an embodiment of a pressure relief-assisted packer in a first configuration.
Figure 2B:
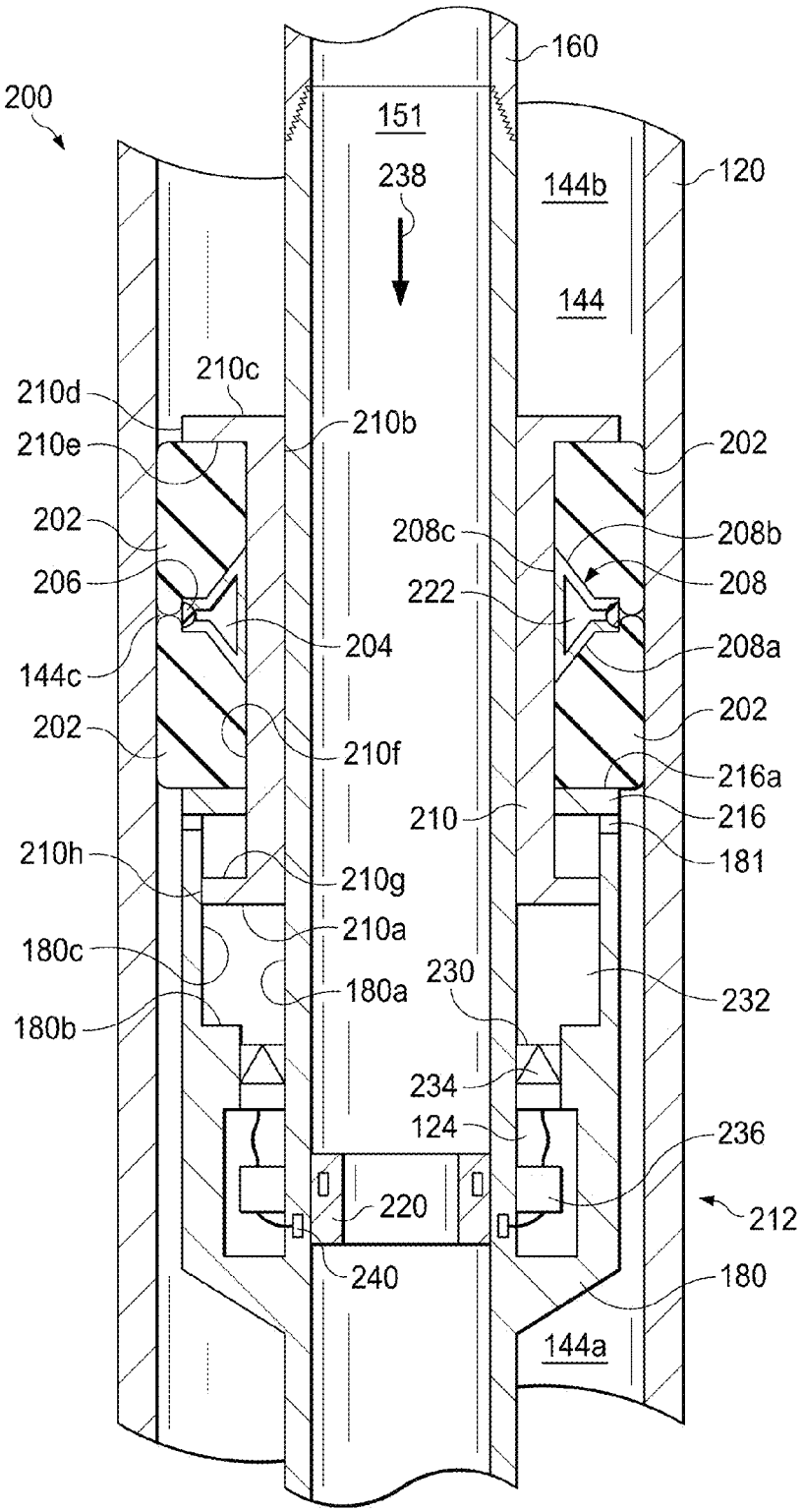
FIG. 2B is a cut-away view of an embodiment of a pressure relief-assisted packer in a second configuration.
Figure 2C:
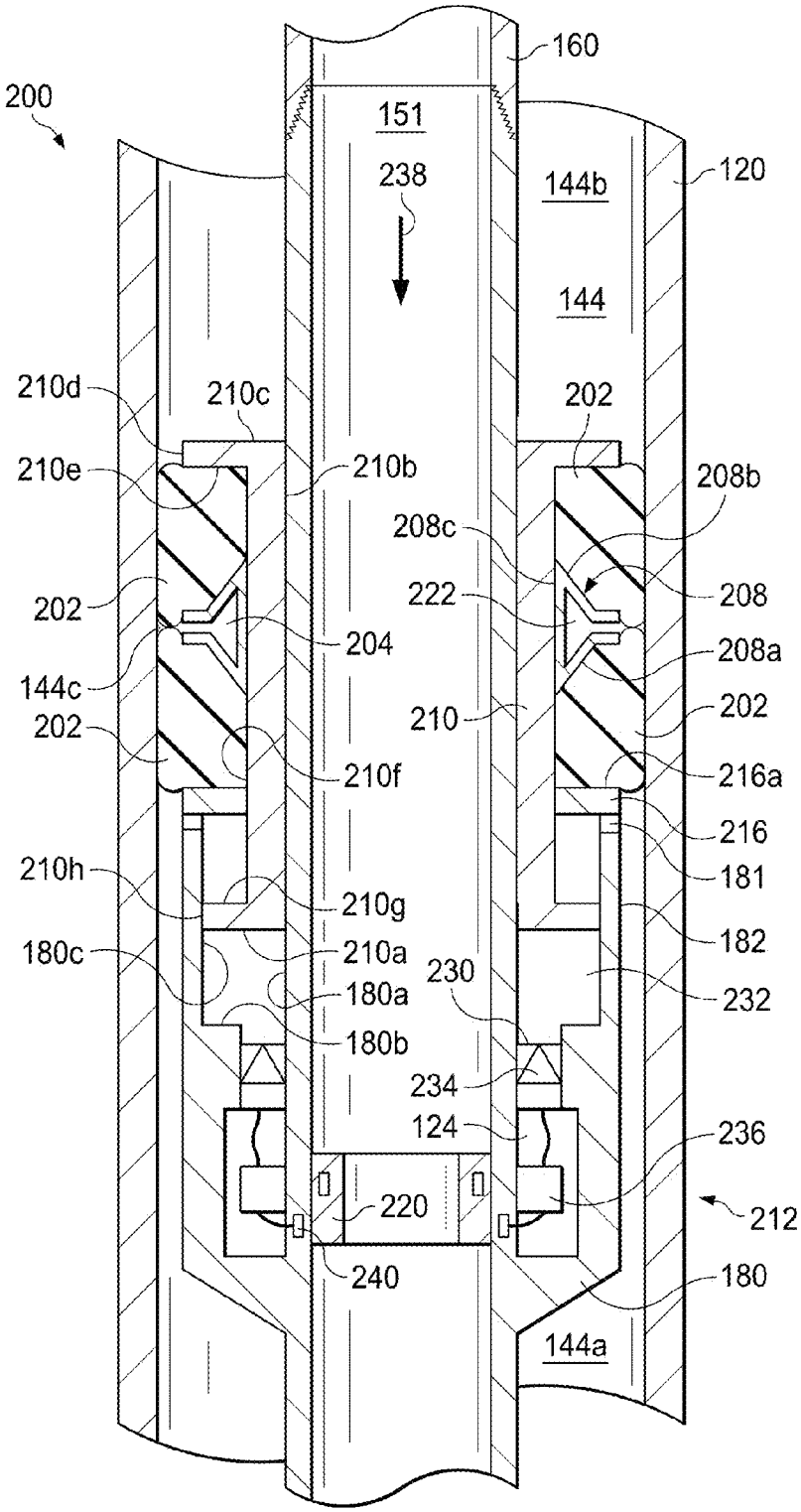
FIG. 2C is a cut-away view of an embodiment of a pressure relief-assisted packer in a third configuration.

Referring to FIGS. 2A-2C, an embodiment of the PRP 200 is illustrated. In the embodiment of FIGS. 2A-2C, the PRP 200 may generally comprise a housing 180, pressure relief chamber 208, two or more packer elements 202, a sliding sleeve 210, and a triggering system 212.

While an embodiment of a PRP (particularly, PRP 200) is disclosed with respect to FIGS. 2A-2C, one of skill in the art, upon viewing this disclosure, will recognize suitable alternative configurations, for example, which may similarly comprise a pressure relief chamber as will be disclosed herein. For example, while the PRP 200 disclosed herein is settable via the operation the triggering system 212 and the movement of the sleeve 210, as will be disclosed herein, a PRP may take any suitable alternative configurations, as will be disclosed herein. As such, while a PRP may be disclosed with reference to a given configuration (e.g., PRP 200, as will be disclosed with respect to FIGS. 2A-2C), this disclosure should not be construed as so-limited.

In an embodiment, the housing 180 of the PRP 200 is a generally cylindrical or tubular-like structure. In an embodiment, the housing 180 may comprise a unitary structure, alternatively, two or more operably connected components. Alternatively, a housing of a PRP 200 may comprise any suitable structure; such suitable structures will be appreciated by those of skill in the art with the aid of this disclosure.

In an embodiment, the PRP 200 may be configured for incorporation into the second tubular 160. In such an embodiment, the housing 180 may comprise a suitable connection to the second tubular 160 (e.g., to a casing string member, such as a casing joint). Suitable connections to a casing string will be known to those of skill in the art. In such an embodiment, the PRP 200 is incorporated within the second tubular 160 such that the axial flowbore 151 of the PRP 200 is in fluid communication with the axial flowbore of the second tubular 160 and/or the first casing string 120.

In an embodiment, the housing may generally comprises a first outer cylindrical surface 180*a*, a first orthogonal face 180*b*, an outer annular portion 182 having a first inner cylindrical surface 180*c* and extending over at least a portion of the first outer cylindrical surface 180*a*, thereby at least partially defining an annular space 180*d* therebetween.

In an embodiment, the housing 180 may comprise an inwardly extending compression shoulder 216, for example, extending radially inward from the annular portion 182. In the embodiment of FIGS. 2A-2C, the compression shoulder 216 comprises an orthogonal compression face 216*a*, positioned generally perpendicular to the axial flowbore 151. Additionally, the compression face 216*a* may remain in a fixed position when a force is applied to the compression face 216*a*, for example, a force generated by a packer element being compressed by the sleeve 210, as will be disclosed herein.

In an alternative embodiment, the compression face 216*a* may be movable and slidably positioned along the exterior of the housing 180, for example, the compression face 216*a* may be incorporated with a piston or a sliding sleeve (e.g., a second sleeve).

In an embodiment, the housing 180 may comprise a recess or chamber configured to house at least a portion of the triggering system 212. For example, in the embodiment of FIGS. 2A-2C, the housing 180 comprises a triggering device compartment 124. In an embodiment, the recess (e.g., compartment) may generally comprise a hollow, a cut-out, a void, or the like. Such a recess may be wholly or substantially contained within the housing 180; alternatively, such a recess may allow access to the all or a portion of the triggering system 212. In an embodiment, the housing 180 may comprise multiple recesses, for example, to contain or house multiple elements of the triggering system 212 and/or multiple triggering systems 212, as will be disclosed herein.

In an embodiment, the packer elements 202 may generally be configured to selectively seal and/or isolate two or more portions of an annular space (e.g., annular space 144), for example, by selectively providing a barrier extending circumferentially around at least a portion of the exterior of the PRP 200 and positioned concentrically between the PRP 200 and a casing string (e.g., the first casing string 120) or other tubular member.

In an embodiment, each of the two or more packer elements 202 may generally comprise a cylindrical structure having an interior bore (e.g., a tube-like and/or a ring-like structure). The packer elements 202 may comprise a suitable interior diameter, a suitable external diameter, and/or a suitable thickness, for example, as may be selected by one of skill in the upon viewing this disclosure and in consideration of factors including, but not limited to, the size/diameter of the housing 180 of the PRP 200, the size/diameter of the tubular against which the packer elements are configured to seal (e.g., the interior bore diameter of the first casing string 120), the force with which the packer elements are configured to engage the tubular against which the packer elements will seal, or other related factors.

In an embodiment, each of the two or more packer elements 202 may be configured to exhibit a radial expansion (e.g., an increase in exterior diameter) upon being subjected to an axial compression (e.g., a force compressing the packer elements in a direction generally parallel to the bore/axis of the packer elements 202). For example, each of the two or more packer elements may comprise (e.g., be formed from) a suitable material, such as an elastomeric compound and/or multiple elastomeric compounds. Examples of suitable elastomeric compounds include, but are not limited to nitrile butadiene rubber (NBR), hydrogenated nitrile butadiene rubber (HNBR), ethylene propylene diene monomer (EPDM), fluoroelastomers (FKM) [for example, commercially available as Viton®], perfluoroelastomers (FFKM) [for example, commercially available as Kalrez®, Chemraz®, and Zalak®], fluoropolymer elastomers [for example, commercially available as Viton®], polytetrafluoroethylene, copolymer of tetrafluoroethylene and propylene (FEPM) [for example, commercially available as Aflas®], and polyetheretherketone (PEEK), polyetherketone (PEK), polyamide-imide (PAI), polyimide [for example, commercially available as Vespel®], polyphenylene sulfide (PPS) [for example, commercially available as Ryton®], and any combination thereof. For example, instead of Aflas®, a fluoroelastomer, such as Viton® available from DuPont, may be used for the packer elements 202. Not intending to be bound by theory, the use of a fluoroelastomer may allow for increased extrusion resistance and a greater resistance to acidic and/or basic fluids. In an embodiment, the packer elements 202 may be constructed of a single layer; alternatively, the packer elements 202 may be constructed of multiple layers (e.g., plies), for example, with each layer or ply comprise either the same, alternatively, different elastomeric compounds.

In an embodiment, the two or more packer elements 202 may be formed from the same material. Alternatively, the two or more packer elements 202 may be formed from different materials. For example, in an embodiment, each of the two or more packer elements 202 may exhibit substantially similarly rates of radial expansion per unit of compression (e.g., compressive force and/or amount of compression). Alternatively, in an embodiment, the two or more packer elements 202 may exhibit different rates of radial expansion per unit of compression (e.g., compressive force and/or amount of compression).

Figure 3:
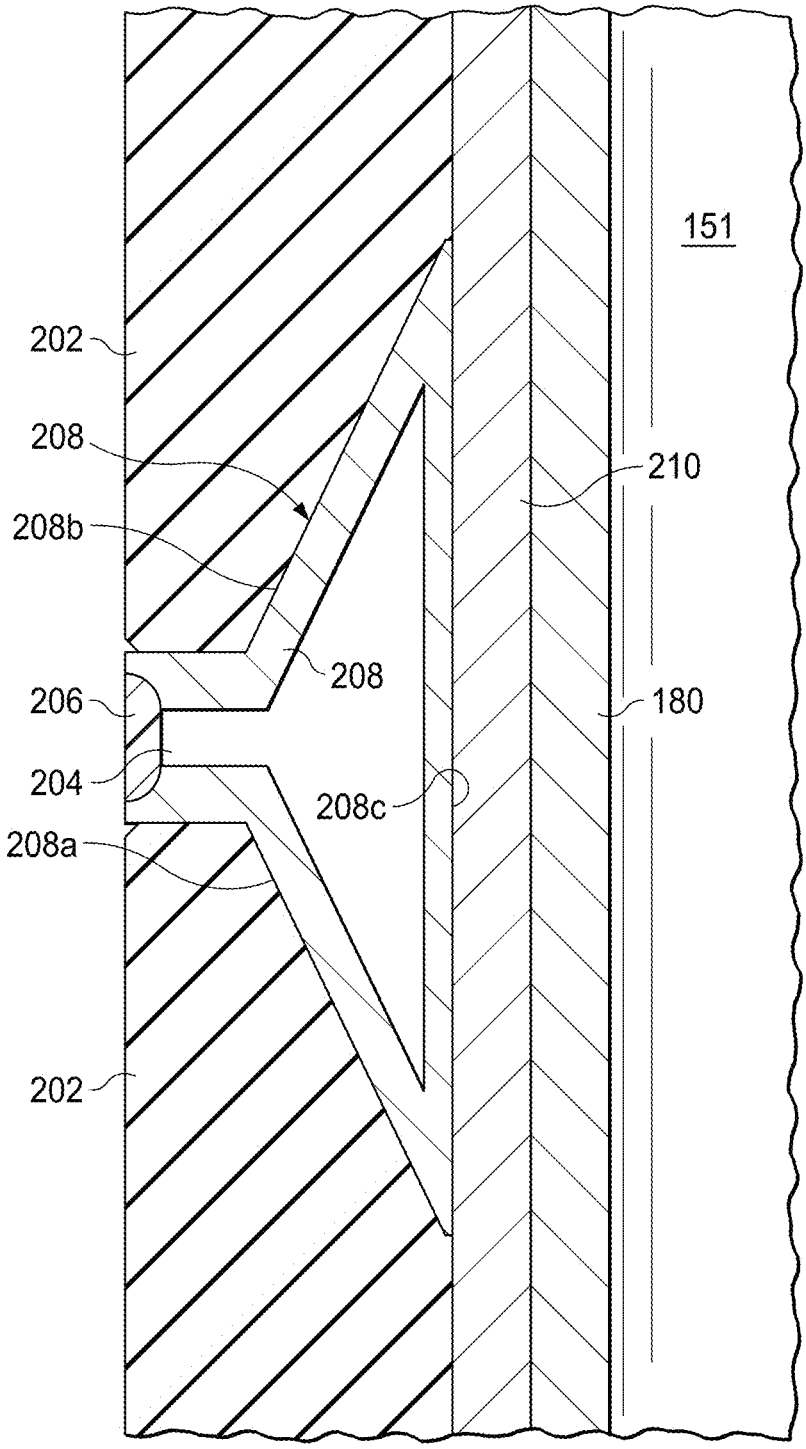
FIG. 3 is a cut-away view of an embodiment of a pressure relief chamber.

In an embodiment, the pressure relief chamber 208, in cooperation with a rupture disc 206, generally encloses and/or defines a pressure relief volume 204. In an embodiment, the pressure relief chamber 208 may comprise a cylindrical or ring-like structure. Referring to FIG. 3, a detailed view of the pressure relief chamber is illustrated. In the embodiment of FIGS. 2A-2C and 3, the pressure relief chamber 208 may comprise a plurality of chamber surfaces 208*a* and 208*b* (e.g., walls) and a base surface 208*c*. In an embodiment, the chamber surfaces 208*a* and 208*b* may be, for example, angled (e.g., inclined) surfaces which converge outwardly (e.g., away from the base surface 208*c*). For example, in such an embodiment, the chamber surfaces 208*a* and/or 208*b* may be constructed and/or oriented (e.g., angled) such that the plurality packer elements 202 may be able to slide laterally along such surfaces and outwardly from the housing 180. For example, in such an embodiment, the chamber surfaces 208*a* and/or 208*b* may comprise "ramps," as will be disclosed in greater detail herein. In such an embodiment, the chamber surfaces 208*a* and/or 208*b* may be oriented at any suitable angle (e.g., exhibiting any suitable degree of rise), as will be appreciated by one of skill in the art upon viewing this disclosure. In an alternative embodiment, the chamber surfaces 208*a* and/or 208*b* may be about perpendicular surfaces with respect to the axial flowbore 151 of the housing 180. In an alternative embodiment, the chamber surfaces 208*a* and/or 208*b* may be oriented to any suitable position as would be appreciated by one of skill in the art.

In an embodiment, the pressure relief chamber 208 may be formed from a suitable material. Examples of suitable materials include, but are not limited to, metals, alloys, composites, ceramics, or combinations thereof.

As noted above, in an embodiment, the chamber surfaces 208*a* and 208*b* of the pressure relief chamber 208 and a rupture disc 206 generally define the pressure relief volume 204, as illustrated in FIGS. 2A-2B and 3. In such an embodiment, the pressure relief volume 204 may be suitably sized, as will be appreciated by one of skill in the art upon viewing this disclosure. For example, in an embodiment, the size and/or volume of the pressure relief volume may be varied, for example, to conform to one or more specifications associated with a particular application and/or operation. Also, in an embodiment, the pressure relief chamber 208 may be characterized as having a suitable cross-sectional shape. For example, while the embodiment of FIGS. 2A-2C and 3 illustrates a generally triangular cross-sectional shape, one of skill in the art, upon viewing this disclosure, will appreciate other suitable design configurations.

In an embodiment, the rupture disc 206 may generally be configured to seal the pressure relief volume. For example, in an embodiment, the rupture disc 206, alternatively, a plurality of rupture discs, be disposed over an opening into the pressure relief chamber 208, for example, via attachment into and/or onto the chamber surfaces 208*a* and 208*b* of the pressure relief chamber 208. In an embodiment, the rupture disc 206 may contain/seal the pressure relief volume 204, for example, as illustrated in FIGS. 2A-2B and 3. In such an embodiment, the rupture disc 206 may provide for isolation of pressures and/or fluids between the interior of the pressure relief chamber 208 (e.g., the pressure relief volume 204) and an exterior of the pressure relief chamber 208. The rupture disc 206 may comprise any suitable number and/or configuration of such components. For example, a pressure relief chamber, like pressure relief chamber 208, may be sealed via a single rupture disc, alternatively, a single rupture panel comprising a ring-like configuration and extending radially around the pressure relief chamber 208, alternatively, a plurality of rupture discs, such as two, three, four, five, six, seven, eight, nine, ten, or more rupture discs.

In an embodiment, the rupture disc 206 may be configured and/or selected to rupture, break, disintegrate, or otherwise loose structural integrity when a desired threshold pressure level (e.g., a differential in the pressures experienced by the rupture disc 206) is experienced (for example, a difference in pressure reached as a result of the compression of the plurality of packer elements 202 proximate to and/or surrounding the rupture disc 206, as will be disclosed herein). In an embodiment, the threshold pressure may be about 1,000 p.s.i., alternatively, at least about 2,000 p.s.i., alternatively, at least at about 3,000 p.s.i, alternatively, at least about 4,000 p.s.i, alternatively, at least about 5,000 p.s.i, alternatively, at least about 6,000 p.s.i, alternatively, at least about 7,000 p.s.i, alternatively, at least about 8,000 p.s.i, alternatively, at least about 9,000 p.s.i, alternatively, at least about 10,000 p.s.i, alternatively, any suitable pressure.

In an embodiment, the rupture disc (e.g., a "burst" disc) 206 may be formed from any suitable material. As will be appreciated by one of skill in the art, upon viewing this disclosure, the choice of the material or materials employed may be dependent upon factors including, but not limited to, the desired threshold pressure. Examples of suitable materials from which the rupture disc may be formed include, but are not limited to, ceramics, glass, graphite, plastics, metals and/or alloys (such as carbon steel, stainless steel, or Hastelloy®), deformable materials such as rubber, or combinations thereof. Additionally, in an embodiment, the rupture disc 206 may comprise a degradable material, for example, an acid-erodible material or thermally degradable material. In such an embodiment, the rupture disc 206 may be configured to lose structural integrity in the presence of a predetermined condition (e.g., exposure to a downhole condition such as heat or an acid), for example, such that the rupture disc 206 is at least partially degraded and will rupture when subjected to pressure.

In an embodiment, the pressure relief chamber 208, when sealed by the rupture disc 206, may contain fluid such as a liquid and/or a gas. In such an embodiment, the fluid contained within the pressure relief chamber 208 may be characterized as compressible. In an embodiment, the pressure within the pressure relief chamber 208, when sealed by the rupture disc 206 (e.g., the pressure of pressure relief volume 204), may be about atmospheric pressure, alternatively, the pressue within the pressure relief chamber 208 may be a negative pressure (e.g., a vacuum), alternatively, about 100 p.s.i., alternatively, about 200 p.s.i., alternatively, about 300 p.s.i, alternatively, about 400 p.s.i, alternatively, about 500 p.s.i, alternatively, about 600 p.s.i, alternatively, about 700 p.s.i, alternatively, about 800 p.s.i, alternatively, about 900 p.s.i, alternatively, at least about 1,000 p.s.i, alternatively, any suitable pressure.

In an alternative embodiment, a pressure relief chamber (e.g., like pressure relief chamber 208) may comprise a pressure relief valve (e.g., a "pop-off-valve"), a blowoff valve, or other like components.

In an embodiment, the sleeve 210 generally comprises a cylindrical or tubular structure, for example having a c-shaped cross-section. In the embodiment of FIGS. 2A-2C, the sliding sleeve 210 generally comprises a lower orthogonal face 210*a*; an upper orthogonal face 210*c*; an inner cylindrical surface 210*b* extending between the lower orthogonal face 210*a* and the upper orthogonal face 210*c*; an upper outer cylindrical surface 210*d*; an intermediary outer cylindrical surface 210*f* extending between an upper shoulder 210*e* and a lower shoulder 210*g*; and a lower outer cylindrical surface 210*h*. In an embodiment, the sleeve 210 may comprise a single component piece; alternatively, a sleeve like the sliding sleeve 210 may comprise two or more operably connected or coupled component pieces (e.g., a collar or collars fixed about a tubular sleeve).

In an embodiment, the sleeve 210 may be slidably and concentrically positioned about and/or around at least a portion of the exterior of the PRP 200 housing 180. For example, in the embodiment of FIGS. 2A-2C, the inner cylindrical surface 210*b* of the sleeve 210 may be slidably fitted against/about at least a portion of the first outer cylindrical surface 180*a* of the housing 180. Also, in the embodiment of FIGS. 2A-2C, the lower outer cylindrical surface 210*h* of the sleeve 210 may be slidably fitted against at least a portion of the first inner cylindrical surface 180*c* of the annular portion 182. As shown in the embodiment of FIGS. 2A-2C, the lower shoulder 210*g* is positioned within the annular space 180*d* defined by the housing 180, the annular portion 182, and the compression shoulder 216. In an embodiment, the sleeve 210 and/or the housing 180 may comprise one or more seals or the like at one or more of the interfaces therebetween. Suitable seals include but are not limited to a T-seal, an O-ring, a gasket, or combinations thereof. For example, in an embodiment, the sleeve 210 and/or the housing 180 may comprise such a seal at the interface between the inner cylindrical surface 210*b* of the sleeve 210 and the first outer cylindrical surface 180*a* of the housing 180 and/or at the interface between the lower outer cylindrical surface 210*h* of the sleeve 210 and the first inner cylindrical surface 180*c* of the annular portion 182. In such an embodiment, the presence of one or more of such seals may create a fluid-tight interaction, thereby preventing fluid communication between such interfaces.

In an embodiment, the housing 180 and the sleeve 210 may cooperatively define a hydraulic fluid reservoir 232. For example, as shown in FIGS. 2A-2C, the hydraulic fluid reservoir 232 is generally defined by the first outer cylindrical surface 180*a*, the first orthogonal face 180*b*, and the first inner cylindrical surface 180*c* of the housing 180 and by the lower orthogonal face 210*a* of the sleeve 210. In an embodiment, the hydraulic fluid reservoir 232 may be characterized as having a variable volume. For example, volume of the hydraulic fluid reservoir 232 may vary with movement of the sleeve 210, as will be disclosed herein.

In an embodiment, fluid access to/from the hydraulic fluid reservoir 232 may be controlled by the destructible member 230. For example, in an embodiment, the hydraulic fluid reservoir 232 may be fluidically connected to the triggering device compartment 124. In an embodiment, the destructible member 230 (e.g., a rupture disc, a rupture plate, etc.) may restrict or prohibit flow through the passage. In an embodiment, any suitable configurations for passage and flow restriction may be used as would be appreciated by one of skill in the art.

In an embodiment, the destructible member 230 may allow for the hydraulic fluid to be substantially contained, for example, within the hydraulic fluid reservoir 232 until a triggering event occurs, as will be disclosed herein. In an embodiment, the destructible member 230 may be ruptured or opened, for example, via the operation of the triggering system 212. In such an embodiment, once the destructible member 230 is open, the hydraulic fluid within the hydraulic fluid reservoir 232 may be free to move out of the hydraulic fluid reservoir 232 via flow passage previously controlled by the destructible member 230.

In an embodiment, the hydraulic fluid may comprise any suitable fluid. In an embodiment, the hydraulic fluid may be characterized as having a suitable rheology. In an embodiment, the hydraulic fluid reservoir 232 is filled or substantially filled with a hydraulic fluid that may be characterized as a compressible fluid, for example a fluid having a relatively low compressibility, alternatively, the hydraulic fluid may be characterized as substantially incompressible. In an embodiment, the hydraulic fluid may be characterized as having a suitable bulk modulus, for example, a relatively high bulk modulus. Particular examples of a suitable hydraulic fluid include silicon oil, paraffin oil, petroleum-based oils, brake fluid (glycol-ether-based fluids, mineral-based oils, and/or silicon-based fluids), transmission fluid, synthetic fluids, or combinations thereof.

In an embodiment, each of the packer elements 202 may be disposed about at least a portion of the sleeve 210, which may be slidably and concentrically disposed about/around at least a portion of the housing 180. In an embodiment, the packer elements 202 may be slidably disposed about the sleeve 210, as will be disclosed herein, for example, such that the packer elements (or a portion thereof) may slide or otherwise move (e.g., axially and/or radially) with respect to the sleeve 210, for example, upon the application of a force to the packer elements 202.

Also, in an embodiment, the pressure relief chamber 208 may also be disposed concentrically about/around at least a portion of the sleeve 210. In an embodiment, the pressure relief chamber 208 may be slidably disposed about the sleeve 210, as will be disclosed herein, for example, such that the pressure relief chamber 208 may slide or otherwise move (e.g., axially and/or radially) with respect to the sleeve 210.

For example, in the embodiment of FIGS. 2A-2C, the packer elements 202 are slidably disposed about/around the sleeve 210 separated (e.g., longitudinally) via the pressure relief chamber 208. For example, in the embodiment of FIGS. 2A-2C, the pressure relief chamber 208 is positioned between the two packer elements 202. For example, in the embodiment of FIGS. 2A-2C, a first of the two packer elements is slidably positioned about the sleeve 210 abutting the upper shoulder 210*e* of the sleeve 210 and also abutting another of the chamber surfaces 208*b* (e.g., ramps) of the pressure relief chamber 208; also, a second of the two packer elements is slidably positioned about the sleeve 210 abutting the compression face 216*a* (e.g., the compression shoulder 216) of the housing 180 and also abutting another of the chamber surfaces 208*a* (e.g., ramps) of the pressure relief chamber 208.

While in the embodiment of FIG. 2A-2C the pressure relief chamber 208 comprises inclined or "ramped" surfaces abutting the packer elements, in an alternative embodiment, the surfaces of the sleeve (e.g., upper shoulder 210*e*) which abut the packer elements 202, the surfaces of the housing (e.g., compression surface 216*a*), the surfaces of the pressure relief chamber 208, or combinations thereof may similarly comprise such "ramped" surfaces, as will be appreciated by one of skill in the art upon viewing this disclosure.

Also, while in the embodiment of FIGS. 2A-2C the packer elements 202 and pressure relief chamber 208 are slidably positioned about the sleeve, in an alternative embodiment, one or more of such components may be at least partially fixed with respect to the sleeve and/or the housing.

In an embodiment, while the PRP 200 comprises two packer elements 202 separated by a single pressure relief chamber 208, one of skill in the art, upon viewing this disclosure, will appreciate that that a similar PRP may comprise three, four, five, six, seven, or more packer elements, with any two adjacent packer elements having a pressure relief chamber (like pressure relief chamber 208, disclosed herein) disposed therebetween.

In an embodiment, the sleeve 210 may be movable with respect to the housing 180, for example, following the destruction of the destructible member 230, as will be disclosed herein. In an embodiment, the sleeve 210 may be slidably movable from a first position (relative to the housing 180) to a second position and from the second position to a third position, as shown in FIGS. 2A, 2B, and 2C, respectively. In an embodiment, the first position may comprise a relatively upward position of the sleeve 210, the third position may comprise a relatively downward position of the sleeve 210, and the second position may comprise an intermediate position between the first and third positions, as will be disclosed herein.

As shown in the embodiment of FIG. 2A, with the sleeve 210 in the first position, the packer elements 202 are relatively uncompressed (e.g., laterally) and, as such, are relatively unexpanded (e.g., radially). In an embodiment, the sleeve 210 may be retained in the first position by the presence of the hydraulic fluid within the hydraulic fluid reservoir 232. For example, in the embodiment of FIG. 2A, the sleeve 210 may be retained in first position where the triggering system 212 has not yet been actuated, as will be disclosed herein, so as to allow the hydraulic fluid to escape and/or be emitted from the hydraulic fluid reservoir 232.

As shown in the embodiment of FIG. 2B, with the sleeve 210 in the second position, the packer elements 202 are relatively more compressed (e.g., laterally) and, as such, relatively more radially expanded (in comparison to the packer elements when the sleeve 210 is in the first position). For example, movement of the sleeve 210 from the first position to the second position, may decrease the space between the upper shoulder 210*e* of the sleeve 210 and the compression face 216*a* of the housing 180, thereby compressing the packer elements 202 and forcing the packer elements 202 to expand radially (for example, against the first casing string 120). In an embodiment, as shown in FIG. 2B, the second position may comprise an intermediate position between the first position and the third position. In an embodiment, following actuation of the triggering system 212, as will be disclosed herein, the sleeve 210 may be configured and/or to allowed move in the direction of second and/or third positions. For example, in an embodiment, the sleeve 210 may be configured to transition from the first position to the second position (and in the direction of the third position) upon the application of a hydraulic (e.g., fluid) pressure to the PRP 200. In such an embodiment, the sleeve 210 may comprise a differential in the surface area of the upward-facing surfaces which are fluidicly exposed and the surface area of the downward-facing surfaces which are fluidicly exposed. For example, in an embodiment, the exposed surface area of the surfaces of the sleeve 210 which will apply a force (e.g., a hydraulic force) in the direction toward the second and/or third position (e.g., a downward force) may be greater than exposed surface area of the surfaces of the sleeve 210 which will apply a force (e.g., a hydraulic force) in the direction away from the second position (e.g., an upward force). For example, in the embodiment of FIGS. 2A-2C, and not intending to be bound by theory, the hydraulic fluid reservoir 232 is fluidicly sealed (e.g., by fluid seals at the interface between the inner cylindrical surface 210*b* of the sleeve 210 and the first outer cylindrical surface 180*a* of the housing 180 and at the interface between the lower outer cylindrical surface 210*h* of the sleeve 210 and the first inner cylindrical surface 180*c* of the annular portion 182), and therefore unexposed to fluid pressures applied (e.g., externally) to the PRP 200, thereby resulting in such a differential in the force applied (e.g., fluidicly) to the sleeve 210 in the direction toward the second/third positions (e.g., a downward force) and the force applied to the sleeve 210 in the direction away from the second position (e.g., an upward force). In an embodiment, a hydraulic pressure applied to the annular space 144 (e.g., by pumping via the annular space 144 and/or as a result of the ambient fluid pressures surrounding the PRP 200) may act upon the surfaces of the sleeve 210, as disclosed herein. For example, in the embodiment of FIG. 2A-2C the fluid pressure may be applied to the upper orthogonal face 210*c* of the sleeve to force in the sleeve 210 toward the second/third position. Additionally, in the embodiment of FIGS. 2A-2C the fluid pressure may also be applied to the lower shoulder 210*g* of the sleeve 210 via port 181 within the housing 180 (e.g., annular portion 182), for example, to similarly force the sleeve 210 toward the second/third position.

As shown in the embodiment of FIG. 2C, with the sleeve 210 in the third position, the packer elements 202 are relatively more compressed (e.g., laterally) and, as such, relatively more radially expanded (in comparison to the packer elements when the sleeve 210 is in both the first position and the second position). For examples, in an embodiment, upon the sleeve 210 approaching and/or reaching the second position, the packer elements 202 expand radially to contact (e.g., compress against) the first casing string 120. As such, the pressure within a portion of the annular space 144 between the two packer elements 202 (e.g., intermediate annular space 144*c*) may increase. For example and not intending to be bound by theory, as the packer elements 202 expand, the volume between the packer elements 202 (e.g., the volume of the intermediate annular space 144*c*) decreases, thereby resulting in an increase of the pressure in this volume. In an embodiment, when the pressure of the volume between the two packer elements 206 meets and/or exceeds the threshold pressure associated with the rupture disc 206, the rupture disc 206 (which is exposed to the intermediate annular space 144*c*) may be configured to rupture, break, disintegrate, or otherwise loose structural integrity, thereby allowing fluid communication between the volume between the two packer elements 206 and the pressure relief chamber 208. In an embodiment, upon allowing fluid communication between the volume between the two packer elements 206 and the pressure relief chamber 208 (e.g., as a result of the rupturing, breaking, disintegrating, or the like of the rupture disc 206), the pressure between the two packer elements 206 may be decreased (e.g., by allowing fluids within the intermediate annular volume 144*c* to move into the pressure relief volume 204). In an embodiment, and not intending to be bound by theory, such a decrease in the pressure may allow the packer elements 206 to be further radially expanded (e.g., by further compression of the sleeve 210). For example, in the embodiment, of FIG. 2C, where the pressure between the two packer elements 206 may be decreased (e.g., by allowing fluids within the intermediate annular volume 114*c* to move into the pressure relief volume 204), the sleeve 210 may be configured and/or allowed to move toward the third position (e.g., from the first and second positions). For example, the sleeve 210 may be further compressed as a result of fluid pressure (e.g., forces) applied thereto.

In an embodiment, PRP 200 may be configured such that the sleeve 210, upon reaching a position in which the packer elements 260 are relatively more compressed (e.g., the second and/or third positions), remains and/or is retained or locked in such a position. For example, in an embodiment, the sleeve 210 and/or the housing 180 may comprise any suitable configuration of locks, latches, dogs, keys, catches, ratchets, ratcheting teeth, expandable rings, snap rings, biased pin, grooves, receiving bores, or any suitable combination of structures or devices. For example, the housing 180 and sleeve 210 may comprise a series of ratcheting teeth configured such that the sleeve 210, upon reaching the third position, will be unable to return in the direction of the first and/or second positions.

In an embodiment, a hydraulic fluid reservoir 232 may be configured to selectively allow the movement of the sleeve 210, for example, as noted above, when the hydraulic fluid is retained in the hydraulic fluid reservoir 232 (e.g., by the destructible member 230), the sleeve 210 may be retained or locked in the first position and, when the hydraulic fluid is not retained in the hydraulic fluid reservoir 232 (e.g., upon destruction or other loss of structural integrity by the destructible member 230), the sleeve 210 may be allowed to move from the first position in the direction of the second and/or third positions, for example, as also disclosed herein. For example, in such an embodiment, during run-in the fluid pressures experienced by the sleeve 210 may cause substantially no movement in the position of the sleeve 210. Additionally or alternatively, the sleeve 210 may be held securely in the first position by one or more shear pins that shear upon application of sufficient fluid pressure to annulus 144.

In an embodiment, the triggering system 212 may be configured to control fluid communication to and/or from the hydraulic fluid reservoir 232. For example, in an embodiment, the destructible member 230 (e.g., which may be configured to allow/disallow fluid access to the hydraulic chamber 232) may be opened (e.g., punctured, perforated, ruptured, pierced, destroyed, disintegrated, combusted, or otherwise caused to cease to enclose the hydraulic fluid reservoir 232) by the triggering system 212. In an embodiment, the triggering system 212 may generally comprise a sensing system 240, a piercing member 234, and electronic circuitry 236. In an embodiment, some or all of the triggering system 212 components may be disposed within the triggering device compartment 124; alternatively, exterior to the housing 180; alternatively, integrated within the housing 180. It is noted that the scope of this disclosure is not limited to any particular configuration, position, and/or number of the pressure sensing systems 240, piercing members 234, and or electronic circuits 236. For example, although the embodiment of FIGS. 2A-2C illustrates a triggering system 212 comprising multiple distributed components (e.g., a single sensing system 240, a single components electronic circuitry 236, and a single piercing member 234, each of which comprises a separate, distinct component), in an alternative embodiment, a similar triggering system may perform similar functions via a single, unitary component; alternatively, the functions performed by these components (e.g., the sensing system 240, the electronic circuitry 236, and the single piercing member 234) may be distributed across any suitable number and/or configuration of like componentry, as will be appreciated by one of skill in the art with the aid of this disclosure.

In an embodiment, the sensing system 240 may comprise a sensor capable of detecting a predetermined signal and communicating with the electronic circuitry 236. For example, in an embodiment, the sensor may be a magnetic pick-up capable of detecting when a magnetic element is positioned (or moved) proximate to the sensor and may transmit a signal (e.g., via an electrical current) to the electronic circuitry 236. In an alternative embodiment, a strain sensor may sense and change in response to variations of an internal pressure. In an alternative embodiment, a pressure sensor may be mounted to the on the tool to sense pressure changes imposed from the surface. In an alternative embodiment, a sonic sensor or hydrophone may sense sound signatures generated at or near the wellhead through the casing and/or fluid. In an alternative embodiment, a Hall Effect sensor, Giant Magnetoresistive (GMR), or other magnetic field sensor may receive a signal from a wiper, dart, or pump tool pumped through the axial flowbore 151 of the PRP 200. In an alternative embodiment, a Hall Effect sensor may sense and increased metal density caused by a snap ring being shifted into a sensor groove as a wiper plug or other pump tool passes through the axial flowbore 151 of the PRP 200. In an alternative embodiment, a Radio Frequency identification (RFID) signal may be generated by one or more radio frequency devices pumped in the fluid through the PRP 200. In an alternative embodiment, a mechanical proximity device may sense a change in a magnetic field generated by a sensor assembly (e.g., an iron bar passing through a coil as part of a wiper assembly or other pump tool). In an alternative embodiment, an inductive powered coil may pass through the axial flowbore 151 of the PRP 200 and may induce a current in sensors within the PRP 200. In an alternative embodiment, an acoustic source in a wiper, dart, or other pump tool may be pumped through the axial flowbore 151 of the PRP 200. In an alternative embodiment, an ionic sensor may detect the presence of a particular component. In an alternative embodiment, a pH sensor may detect pH signals or values.

In an embodiment, the electronic circuitry 236 may be generally configured to receive a signal from the sensing system 240, for example, so as to determine if the sensing system 240 has experienced a predetermined signal), and, upon a determination that such a signal has been experienced, to output an actuating signal to the piercing member 234. In such an embodiment, the electronic circuitry 236 may be in signal communication with the sensing system 240 and/or the piercing member 234. In an embodiment, the electronic circuitry 236 may comprise any suitable configuration, for example, comprising one or more printed circuit boards, one or more integrated circuits, a one or more discrete circuit components, one or more microprocessors, one or more microcontrollers, one or more wires, an electromechanical interface, a power supply and/or any combination thereof. As noted above, the electronic circuitry 236 may comprise a single, unitary, or non-distributed component capable of performing the function disclosed herein; alternatively, the electronic circuitry 236 may comprise a plurality of distributed components capable of performing the functions disclosed herein.

In an embodiment, the electronic circuitry 236 may be supplied with electrical power via a power source. For example, in such an embodiment, the PRP 200 may further comprise an on-board battery, a power generation device, or combinations thereof. In such an embodiment, the power source and/or power generation device may supply power to the electronic circuitry 236, to the sensing system 240, to the piercing member 234, or combinations thereof. Suitable power generation devices, such as a turbo-generator and a thermoelectric generator are disclosed in U.S. Pat. No. 8,162,050 to Roddy, et al., which is incorporated herein by reference in its entirety. In an embodiment, the electronic circuitry 236 may be configured to output a digital voltage or current signal to the piercing member 234 upon determining that the sensing system 240 has experienced a predetermined signal, as will be disclosed herein.

In the embodiment of FIGS. 2A-2C, the piercing member 234 comprises a punch or needle. In such an embodiment, the piercing member 234 may be configured, when activated, to puncture, perforate, rupture, pierce, destroy, disintegrate, combust, or otherwise cause the destructible member 230 to cease to enclose the hydraulic fluid reservoir 232. In such an embodiment, the piercing member 234 may be electrically driven, for example, via an electrically-driven motor or an electromagnet. Alternatively, the punch may be propelled or driven via a hydraulic means, a mechanical means (such as a spring or threaded rod), a chemical reaction, an explosion, or any other suitable means of propulsion, in response to receipt of an activating signal. Suitable types and/or configuration of piercing member 234 are described in U.S. patent application Ser. Nos. 12/688,058 and 12/353,664, the entire disclosures of which are incorporated herein by this reference, and may be similarly employed. In an alternative embodiment, the piercing member 234 may be configured to cause combustion of the destructible member. For example, the destructible member 230 may comprise a combustible material (e.g., thermite) that, when detonated or ignited may burn a hole in the destructible member 230. In an embodiment, the piercing member 234 may comprise a flow path (e.g., ported, slotted, surface channels, etc.) to allow hydraulic fluid to readily pass therethrough. In an embodiment, the piercing member 234 comprises a flow path having a metering device of the type disclosed herein (e.g., a fluidic diode) disposed therein. In an embodiment, the piercing member 234 comprises ports that flow into the fluidic diode, for example, integrated internally within the body of the piercing member 234.

In an embodiment, upon destruction of the destructible member 230 (e.g., open), the hydraulic fluid within hydraulic fluid chamber 232 may be free to move out of the hydraulic fluid chamber 232 via the pathway previously contained/obstructed by the destructible member 230. For example, in the embodiment of FIGS. 2A-2C, upon destruction of the destructible member 230, the hydraulic fluid chamber 232 may be configured such that the hydraulic fluid may be free to flow out of the hydraulic fluid chamber and into the triggering device compartment 124. In alternative embodiments, the hydraulic fluid chamber 232 may be configured such that the hydraulic fluid flows into a secondary chamber (e.g., an expansion chamber), out of the PRP 200 (e.g., into the wellbore, for example, via a check-valve or fluidic diode), into the flow passage, or combinations thereof. Additionally or alternatively, the hydraulic fluid chamber 232 may be configured to allow the fluid to flow therefrom at a predetermined or controlled rate. For example, in such an embodiment, the atmospheric chamber may further comprise a fluid meter, a fluidic diode, a fluidic restrictor, or the like. For example, in such an embodiment, the hydraulic fluid may be emitted from the atmospheric chamber via a fluid aperture, for example, a fluid aperture which may comprise or be fitted with a fluid pressure and/or fluid flow-rate altering device, such as a nozzle or a metering device such as a fluidic diode. In an embodiment, such a fluid aperture may be sized to allow a given flow-rate of fluid, and thereby provide a desired opening time or delay associated with flow of hydraulic fluid exiting the hydraulic fluid chamber 232 and, as such, the movement of the sleeve 210. Fluid flow-rate control devices and methods of utilizing the same are disclosed in U.S. patent application Ser. No. 12/539,392, which is incorporated herein in its entirety by this reference.

In an embodiment, a signal may comprise any suitable device, condition, or otherwise detectable event recognizable by the sensing system 240. For example, in the embodiment of FIG. 2A-2C, a signal (e.g., denoted by flow arrow 238) comprises a modification and/or transmission of a magnetic signal, for example, by dropping a ball or dart to engage, move, and or manipulate a signaling element 220. In an alternative embodiment, the signal 238 may comprise a modification and/or transmission of a magnetic signal from a pump tool or other apparatus pumped through the axial flowbore 151 of the PRP 200. In another embodiment, the signal 238 may comprise a sound generated proximate to a wellhead and passing through fluid within the axial flowbore 151 of the PRP 200. Additionally or alternatively, the signal 238 may comprise a sound generated by a pump tool or other apparatus passing through the axial flowbore 151 of the PRP 200. In an alternative embodiment, the signal 238 may comprise a current induced by an inductive powered device passing through the axial flowbore 151 of the PRP 200. In an alternative embodiment, the signal 238 may comprise a RFID signal generated by radio frequency devices pumped with fluid passing through the axial flowbore 151 of the PRP 200. In an alternative embodiment, the signal 238 may comprise a pressure signal induced from the surface in the well which may then be picked up by pressure transducers or strain gauges mounted on or in the housing 180 of the PRP 200. In an alternative embodiment, any other suitable signal may be transmitted to trigger the triggering device 212, as would be appreciated by one of skill in the art. Suitable signals and/or methods of applying such signals for recognition by wellbore tool (such as the PRP 200) comprising a triggering system are disclosed in U.S. patent application Ser. No. 13/179,762 entitled "Remotely Activated Downhole Apparatus and Methods" to Tips, et al, and in U.S. patent application Ser. No. 13/179,833 entitled "Remotely Activated Downhole Apparatus and Methods" to Tips, et al, and U.S. patent application Ser. No. 13/624,173 to Streich, et al. and entitled Method of Completing a Multi-Zone Fracture Stimulation Treatment of a Wellbore, each of which is incorporated herein in its entirety by reference.

In an embodiment, while the PRP 200 has been disclosed with respect to FIGS. 2A-2C and 3, one of skill in the art, upon viewing this disclosure, will recognize that a similar PRP may take various alternative configurations. For example, while in the embodiment(s) disclosed herein with reference to FIGS. 2A-2C, the PRP 200 comprises compression-set packer configuration utilizing a single sleeve (e.g., sleeve 210, which applies pressure to the packer elements), in additional or alternative embodiments a similar PRP may comprise a compression set packer utilizing multiple movable sleeves. Additionally or alternatively, while the PRP disclosed here is set via the application of a fluid pressure to the sleeve (e.g., acting upon a differential area), in another embodiment, a PRP may be set via the operation of a ball or dart (e.g., which engages a seat to apply pressure to one or more ramps and thereby compress the packer elements). In still other embodiments, the pressure relief-assisted packer may comprise one or more swellable packer elements, for example, having a pressure relief chamber like pressure relief chamber 208 disposed therebetween as similarly disclosed herein. Examples of commercially available configurations of packers as may comprise a pressure relief-assisted packer (e.g., like PRP 200) include the Presidium EC2™ and the Presidium MC2™, commercially available from Halliburton Energy Services. Additionally or alternatively, suitable packer configurations are disclosed in U.S. patent application Ser. No. 13/414,140 entitled "External Casing Packer and Method of Performing Cementing Job" to Helms, et al., U.S. patent application Ser. No. 13/414,016 entitled "Remotely Activated Down Hole System and Methods" to Acosta, et al. and U.S. application Ser. No. 13/350,030 entitled "Double Ramp Compression Packer" to Acosta et al., each of which is incorporated herein in its entirety by reference.

In an embodiment, a wellbore completion method utilizing a PRP (such as the PRP 200) is disclosed herein. An embodiment of such a method may generally comprise the steps of positioning the PRP 200 within a first wellbore tubular (e.g., first casing string 120) that penetrates the subterranean formation 102; and setting the PRP 200 such that, during the setting of the PRP 200, the pressure between the plurality of packer elements 202 comes into fluid communication with the pressure relief volume 204.

Additionally, in an embodiment, a wellbore completion method may further comprise cementing a lower annular space 144*a* (e.g., below the plurality of packer elements 202), cementing an upper annular space 144*b* (e.g., above the plurality of packer elements 202), or combinations thereof.

In an embodiment, the wellbore completion method comprises positioning or "running in" a second tubular (e.g., a second casing string) 160 comprising a PRP 200. For example, as illustrated in FIG. 1, second tubular 160 may be positioned within the flow bore of first casing string 120 such that the PRP 200, which is incorporated within the second tubular string 160, is positioned within the first casing string 120.

In an embodiment, the PRP 200 is introduced and/or positioned within a first casing string 120 in a first configuration (e.g., a run-in configuration) as shown in FIG. 2A, for example, in a configuration in which the packer elements 202 are relatively uncompressed and radially unexpanded. In the embodiment of FIGS. 2A-2C as disclosed herein, the sleeve 210 is retained in the first position the hydraulic fluid, which is selectively retained within the hydraulic fluid reservoir as disclosed herein.

In an embodiment, setting the PRP 200 generally comprises actuating the PRP 200 for example, such that the packer elements 202 are caused to expand (e.g., radially), for example, such that the pressure within a portion of the annular space 144 between the packer elements 202 (e.g., the intermediate annular space 144*c*) approaches the threshold pressure associated with the rupture disc 206.

For example, in an embodiment as disclosed with reference to FIGS. 2A-2C, setting the PRP 200 may comprise passing a signal (e.g., signal 238) through the axial flowbore 151 of the PRP 200. As disclosed herein, passing the signal 238 may comprise communicating a suitable signal, as disclosed herein. In such an embodiment, upon recognition of the signal, the triggering system 212 of the PRP 200 may be actuated, for example, such that the destructible member 230 (e.g., a rupture disc) is caused to release the hydraulic fluid from the hydraulic fluid reservoir 232 (e.g., into the triggering compartment 124), thereby allowing the sleeve to move from the first position, as also disclosed herein. Also, in such an embodiment, the release of the hydraulic fluid pressure from the hydraulic fluid reservoir 232 may allow the sleeve 210 to move along the exterior of the housing 180 in the direction of the compression face 216*a* (e.g., in the direction of the second/third positions). In such an embodiment, setting the PRP 200 may further comprise applying a fluid pressure to the PRP 200 (e.g., via the annular space 144), for example, to cause the sleeve 210 to move in the direction of the second and/or third positions, thereby causing the packer elements 202 to expand outwardly to engage the first casing string 120.

In alternative embodiments, setting a PRP like PRP 200 may comprise communicating an obturating member (e.g., a ball or dart), for example, so as to engage a seat within the PRP. Upon engagement of the seat, the obturating member may substantially restrict fluid communication via the axial flowbore of the PRP and, hydraulic and/or fluid pressure (e.g., by pumping via the axial flowbore) applied to seat via the ball or dart may be employed to cause the radial expansion of the packer elements.

In an embodiment, as the packer elements 202 expand radially outward, the packer elements 202 may come into contact with the first casing string 120. In such an embodiment, the plurality of packer elements 202 may isolate an upper annular space 144*b* from a lower annular space 144*a*, such that fluid communication is disallowed therebetween via the radially expanded packer elements 202. Also, as disclosed above, the packer elements 202 may also isolate a portion of the annular space 144 between the packer elements 202, that is, the intermediate annular space 144*c*.

Also, as the packer elements 202 expand radially outward the pressure within the intermediate annular space 144*c* increases, for example, as the sleeve 210 approaches the second position, until the pressure meets and/or exceeds the threshold pressure associated with the rupture disc 206. In an embodiment, upon the pressure within the intermediate annular space 144*c* reaching the threshold pressure of the rupture disc 206 (e.g., between the plurality of packer elements 202) the rupture disc 206 may rupture, break, disintegrate, or otherwise fail, thereby allowing the intermediate annular space 144*c* to be exposed to the pressure relief volume 204, thereby allowing the pressure within the intermediate annular space 144*c* (e.g., fluids) to enter the pressure relief volume 204. In such an embodiment, the pressure between the packer elements 202 may be dissipated, for example, thereby allowing further compression of the packer elements 202. For example, in the embodiment disclosed with respect to FIGS. 2A-2C, upon the dissipation of pressure between the packer elements, the sleeve 210 may be moved further in the direction of the third position, thereby further compressing the packer elements 202 and causing the packer elements 202 be further radially expanded. In such an embodiment, the further compression of the packer elements 202 may cause an improved pressure seal between the first casing string 120 and the second tubular 160, for example and not intending to be bound by theory, resulting from the increased compression of the packer elements 202 against the first casing string 120.

In an embodiment, the wellbore completion method may further comprise cementing at least a portion of the second tubular 160 (e.g., a second casing string) within the wellbore 114, for example, so as to secure the second tubular with respect to the formation 102. In an embodiment, the wellbore completion method may further comprise cementing all or a portion of the upper annular space 144*b* (e.g., the portion of the annular space 144 located uphole from and/or above the packer elements 202). For example, as disclosed herein, the multiple stage cementing tool 140 positioned uphole from the PRP 200 may allow access to the upper annular space 144*b* while the PRP 200 provides isolation of the upper annular space 144*b* from the lower annular space 144*a* (e.g., thereby providing a "floor" for a cement column within the upper annular space 144*b*). In such an embodiment, cement (e.g., a cementitious slurry) may be introduced into the upper annular space 144*b* (e.g., via the multiple stage cementing tool) and allowed to set.

In an additional or alternative embodiment, the wellbore completion method may further comprise cementing the lower annular space 144*a* (e.g., the portion of the annular space located downhole from and/or below the packer elements 202). For example, in such an embodiment, cement may be introduced into the lower annular space 144*a* (e.g., via a float shoe integrated within the second tubular 160 downhole from the PRP 200, e.g., adjacent a terminal end of the second tubular 160) and allowed to set.

In an embodiment, a PRP as disclosed herein or in some portion thereof, may be advantageously employed in a wellbore completion system and/or method, for example, in connecting a first casing string 120 to a second tubular (e.g., a second casing string) 160. Particularly, and as disclosed herein, a pressure relief-assisted packer may be capable of engaging the interior of a casing (or other tubular within which the pressure relief-assisted packer is positioned) with increased radial force and/or pressure (relative to conventional packers), thereby yielding improved isolation. For example, in an embodiment, the use of such a pressure relief-assisted packer enables improved isolation between two or more portions of an annular space (e.g., as disclosed herein) relative to conventional apparatuses, systems, and/or methods. Therefore, such a pressure relief-assisted packer may decrease the possibility of undesirable gas and/or fluid migration via the annular space. Also, in an embodiment, the use of such a pressure relief-assisted packer may result in an improved connection (e.g., via the packer elements) between concentric tubulars (e.g., a first and second casing string) disposed within a wellbore.

ADDITIONAL DISCLOSURE

The following are nonlimiting, specific embodiments in accordance with the present disclosure:

A first embodiment, which is a wellbore completion method comprising:

disposing a pressure relief-assisted packer comprising two packer elements within an axial flow bore of a first tubular string disposed within a wellbore so as to define an annular space between the pressure relief-assisted packer and the first tubular string; and setting the pressure relief-assisted packer such that a portion of the annular space between the two packer elements comes into fluid communication with a pressure relief volume during the setting of the pressure relief-assisted packer.

A second embodiment, which is the method of the first embodiment, wherein disposing the pressure relief-assisted packer within the axial flow bore of the first tubular string comprises disposing at least a portion of a second tubular string within the axial flow bore of the first tubular string, wherein the pressure relief-assisted packer is incorporated within the second tubular string.

A third embodiment, which is the method of the second embodiment, wherein the first tubular string, the second tubular string, or both comprises a casing string.

A fourth embodiment, which is the method of one of the first through the third embodiments, wherein setting the pressure relief-assisted packer comprises longitudinally compressing the two packer elements.

A fifth embodiment, which is the method of the fourth embodiment, wherein longitudinally compressing the two packer elements causes the two packer elements to expand radially.

A sixth embodiment, which is the method of the fifth embodiment, wherein radial expansion of the two packer elements causes the two packer elements to engage the first tubular string.

A seventh embodiment, which is the method of one of the first through the sixth embodiments, wherein the pressure relief volume is at least partially defined by a pressure relief chamber.

An eighth embodiment, which is the method of one of the first through the seventh embodiments, wherein the portion of the annular space between the two packer elements comes into fluid communication with the pressure relief volume upon the portion of the annular space reaching at least a threshold pressure.

A ninth embodiment, which is the method of one of the second through the third embodiments, further comprising:

introducing a cementitious slurry into an annular space surrounding at least a portion of the second tubular string and relatively downhole from the two packer elements; and allowing the cementitious slurry to set.

A tenth embodiment, which is the method of one of the second through the third embodiments, further comprising:

introducing a cementitious slurry into an annular space between the second tubular string and the first tubular string and relatively uphole from the two packer elements; and allowing the cementitious slurry to set.

An eleventh embodiment, which is a wellbore completion system comprising:

a pressure relief-assisted packer, wherein the pressure relief-assisted packer is disposed within an axial flow bore of a first casing string disposed within a wellbore penetrating a subterranean formation, and wherein the pressure relief-assisted packer comprises:

a first packer element;

a second packer element; and a pressure relief chamber, the pressure relief chamber at least partially defining a pressure relief volume, wherein the pressure relief volume relieves a pressure between the first packer element and the second packer element; and a second casing string, wherein the pressure relief-assisted packer is incorporated within the second casing string.

A twelfth embodiment, which is the wellbore completion system of the eleventh embodiment, wherein the pressure relief chamber comprises a rupture disc, wherein the rupture disc controls fluid communication to the pressure relief volume.

A thirteenth embodiment, which is the wellbore completion system of the twelfth embodiment, wherein the rupture disc allows fluid communication to the pressure relief volume upon experiencing at least a threshold pressure.

A fourteenth embodiment, which is the wellbore completion system of the thirteenth embodiment, wherein the threshold pressure is in the range of from about 1,000 p.s.i. to about 10,000 p.s.i.

A fifteenth embodiment, which is the wellbore completion system of one of the thirteenth through the fourteenth embodiments, wherein the threshold pressure is in the range of from about 4,000 p.s.i. to about 8,000 p.s.i.

A sixteenth embodiment, which is the wellbore completion system of one of the eleventh through the fifteenth embodiments, wherein the pressure relief chamber comprises one or more ramped surfaces.

A seventeenth embodiment, which is the wellbore completion system of one of the eleventh through the sixteenth embodiments, wherein the pressure relief chamber is positioned between the first packer element and the second packer element.

An eighteenth embodiment, which is a wellbore completion method comprising:

disposing a pressure relief-assisted packer within an axial flow bore of a first tubular string disposed within a wellbore, wherein the pressure relief-assisted packer comprises:

a first packer element;

a second packer element; and a pressure relief chamber, the pressure relief chamber at least partially defining a pressure relief volume;

causing the first packer element and the second packer element to expand radially so as to engage the first tubular string, wherein causing the first packer element and the second packer element to expand radially causes an increase in pressure in an annular space between the first packer element and the second packer element, wherein the increase in pressure in the annular space causes the pressure relief volume to come into fluid communication with the annular space.

A nineteenth embodiment, which is the wellbore completion method of the eighteenth embodiment, wherein the pressure relief chamber comprises a rupture disc, wherein the rupture disc controls fluid communication to the pressure relief volume.

A twentieth embodiment, which is the wellbore completion method of the nineteenth embodiment, wherein the rupture disc allows fluid communication to the pressure relief volume upon experiencing at least a threshold pressure.

A twenty-first embodiment, which is the wellbore completion method of one of the eighteenth through the twentieth embodiments, wherein the pressure relief-assisted packer is incorporated within a second tubular string.

A twenty-second embodiment, which is the wellbore completion method of the twenty-first embodiment, further comprising:

introducing a cementitious slurry into an annular space surrounding at least a portion of the second tubular string and relatively downhole from the first and second packer elements; and allowing the cementitious slurry to set.

A twenty-third embodiment, which is the wellbore completion method of the twenty-first embodiment, further comprising:

introducing a cementitious slurry into an annular space between the second tubular string and the first tubular string and relatively uphole from the first and second packer elements; and allowing the cementitious slurry to set.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, Rl, and an upper limit, Ru, is disclosed, any number falling within the range is specifically disclosed. In particular, the following numbers within the range are specifically disclosed: R=Rl+k*(Ru−Rl), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. A wellbore completion method comprising:

disposing a pressure relief-assisted packer comprising two packer elements within an axial flow bore of a first tubular string disposed within a wellbore so as to define an annular space between the pressure relief-assisted packer and the first tubular string, wherein the pressure relief-assisted packer further comprises a pressure relief volume fully enclosed within a pressure relief chamber and sealed by a rupture disk disposed between the annular space and the pressure relief chamber; and setting the pressure relief-assisted packer such that the rupture disk loses structural integrity due to a pressure within the annular space reaching a threshold pressure, and allows fluid communication between the annular space and the pressure relief volume during the setting of the pressure relief-assisted packer.

2. The method of claim 1, wherein disposing the pressure relief-assisted packer within the axial flow bore of the first tubular string comprises disposing at least a portion of a second tubular string within the axial flow bore of the first tubular string, wherein the pressure relief-assisted packer is incorporated within the second tubular string.

3. The method of claim 2, wherein the first tubular string, the second tubular string, or both comprises a casing string.

4. The method of claim 2, further comprising:

introducing a cementitious slurry into an annular space surrounding at least a portion of the second tubular string and relatively downhole from the two packer elements; and allowing the cementitious slurry to set.

5. The method of claim 2, further comprising:

introducing a cementitious slurry into an annular space between the second tubular string and the first tubular string and relatively uphole from the two packer elements; and allowing the cementitious slurry to set.

6. The method of claim 1, wherein setting the pressure relief-assisted packer comprises longitudinally compressing the two packer elements to cause the two packer elements to expand radially such that the two packer elements engage the first tubular string.

7. The method of claim 1, further comprising allowing the first packer element and the second packer element to slide laterally along two oppositely facing angled surfaces of the pressure relief chamber during the setting of the pressure relief-assisted packer.

8. The method of claim 1, further comprising maintaining a volume of fluid within the pressure relief chamber when the pressure relief chamber is sealed by the rupture disk.

9. A wellbore completion system comprising:

a pressure relief-assisted packer, wherein the pressure relief-assisted packer is disposed within an axial flow bore of a first casing string disposed within a wellbore penetrating a subterranean formation, and wherein the pressure relief-assisted packer comprises:

a first packer element;

a second packer element; and a pressure relief chamber for fully enclosing a pressure relief volume, wherein the pressure relief chamber comprises a rupture disk for sealing the pressure relief chamber, the rupture disk being disposed between the pressure relief volume and an annular space between the pressure relief-assisted packer and the first casing string, wherein the rupture disk is configured to lose structural integrity due to a pressure within the annular space reaching a threshold pressure to allow fluid communication between the pressure relief volume and the annular space such that the pressure relief volume relieves a pressure between the first packer element and the second packer element; and a second casing string, wherein the pressure relief-assisted packer is incorporated within the second casing string.

10. The wellbore completion system of claim 9, wherein the threshold pressure is in the range of from about 1,000 p.s.i. to about 10,000 p.s.i.

11. The wellbore completion system of claim 9, wherein the threshold pressure is in the range of from about 4,000 p.s.i. to about 8,000 p.s.i.

12. The wellbore completion system of claim 9, wherein the pressure relief chamber comprises one or more ramped surfaces.

13. The wellbore completion system of claim 12, wherein the first and second packer elements are positioned on opposite sides of the pressure relief chamber and slidable relative to the pressure relief chamber such that the first packer element can slide laterally along a first ramped surface of the pressure relief chamber and the second packer element can slide laterally along a second ramped surface of the pressure relief chamber.

14. The wellbore completion system of claim 9, wherein the pressure relief chamber comprises a cylindrical or ring-like structure.

15. The wellbore completion system of claim 14, wherein the rupture disk comprises a rupture panel with a ring-like configuration and extending radially around the pressure relief chamber.

16. The wellbore completion system of claim 9, wherein the pressure relief chamber comprises a triangular cross-sectional shape.

17. The wellbore completion system of claim 9, wherein the pressure relief chamber comprises a base surface, a first chamber surface, and a second chamber surface, wherein the first and second chamber surfaces converge outwardly away from the base surface, and wherein the rupture disk is disposed at a point of convergence of the first and second chamber surfaces to control fluid communication into or out of the pressure relief chamber.

18. The wellbore completion system of claim 9, wherein the pressure relief chamber further comprises a plurality of rupture disks for sealing the pressure relief chamber.

19. The wellbore completion system of claim 9, wherein the pressure relief chamber contains a fluid when sealed by the rupture disk.

20. A wellbore completion method comprising:

disposing a pressure relief-assisted packer within an axial flow bore of a first tubular string disposed within a wellbore, wherein the pressure relief-assisted packer comprises:

a first packer element;

a second packer element; and a pressure relief chamber fully enclosing a pressure relief volume, wherein the pressure relief chamber comprises a rupture disk for sealing the pressure relief chamber, the rupture disk being disposed between the pressure relief volume and an annular space between the first packer element and the second packer element;

causing the first packer element and the second packer element to expand radially so as to engage the first tubular string, wherein causing the first packer element and the second packer element to expand radially causes an increase in pressure in the annular space between the first packer element and the second packer element, wherein the increase in pressure in the annular space causes the rupture disk to lose structural integrity upon reaching a threshold pressure to allow the pressure relief volume to come into fluid communication with the annular space.

21. The wellbore completion method of claim 20, wherein the pressure relief-assisted packer is incorporated within a second tubular string.

22. The wellbore completion method of claim 20, further comprising longitudinally compressing the first and second packer elements to cause the first and second packer elements to expand radially, and allowing the first packer element and the second packer element to slide laterally along angled surfaces of the pressure relief chamber as the first and second packer elements are longitudinally compressed.

23. The wellbore completion method of claim 20, causing the first and second packer elements to expand radially comprises:

enabling fluid communication to or from a hydraulic fluid reservoir defined by a housing of the pressure relief-assisted packer and a sleeve of the pressure relief-assisted packer;

sliding the sleeve laterally with respect to the housing in response to fluid communication to or from the hydraulic fluid reservoir; and compressing the first and second packer elements laterally between a surface of the sleeve and a surface of the housing as the sleeve slides laterally with respect to the housing, wherein the first packer element is disposed between the surface of the sleeve and a first surface of the pressure relief chamber, and wherein the second packer element is disposed between the surface of the housing and an opposing second surface of the pressure relief chamber.

* * * * *